US007395001B2

(12) United States Patent
Gomi

(10) Patent No.: US 7,395,001 B2
(45) Date of Patent: Jul. 1, 2008

(54) ELECTROPHOTOGRAPHIC IMAGE FORMING APPARATUS

(75) Inventor: Fumiteru Gomi, Chiba-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 361 days.

(21) Appl. No.: 11/251,925

(22) Filed: Oct. 18, 2005

(65) Prior Publication Data

US 2006/0083525 A1 Apr. 20, 2006

(30) Foreign Application Priority Data

Oct. 20, 2004 (JP) ..... 2004-306256

(51) Int. Cl.
*G03G 15/00* (2006.01)
*G03G 21/20* (2006.01)
*G03G 15/02* (2006.01)

(52) U.S. Cl. ..... 399/44; 399/94; 399/116

(58) Field of Classification Search ..... 399/44, 399/94, 97, 116
See application file for complete search history.

(56) References Cited

U.S. PATENT DOCUMENTS

| | | | | |
|---|---|---|---|---|
| 4,985,330 A | | 1/1991 | Tsuchiya et al. | 430/130 |
| 5,034,772 A | * | 7/1991 | Suzuki | 399/44 |
| 5,427,880 A | | 6/1995 | Tamura et al. | 430/59 |
| 5,818,489 A | | 10/1998 | Yoshinaga et al. | 347/131 |
| 6,180,303 B1 | | 1/2001 | Uematsu et al. | 430/59.6 |
| 6,489,069 B1 | * | 12/2002 | Itami et al. | 430/58.2 |

FOREIGN PATENT DOCUMENTS

| | | |
|---|---|---|
| JP | 2-127652 | 5/1990 |
| JP | 5-216249 | 8/1993 |
| JP | 7-72640 | 3/1995 |
| JP | 8-272197 | 10/1996 |
| JP | 2000-66425 | 3/2000 |

* cited by examiner

*Primary Examiner*—David M Gray
*Assistant Examiner*—Joseph S. Wong
(74) *Attorney, Agent, or Firm*—Fitzpatrick, Cella, Harper & Scinto

(57) ABSTRACT

An electrophotographic image forming apparatus in which a reduction in image density when continuous sheet supply endurance is effected under a low-humidity environment is prevented, and under a high-humidity environment, an image deletion is prevented. A photosensitive member has an undercoat layer, a charge generating layer and a charge transport layer, and the surface layer of the photosensitive member contains a compound of which at least one polymerization functional group has been polymerized or cross-linked and hardened. Also, the hardening of the surface layer is effected by electron irradiation. A temperature raising apparatus for heating the surface of the photosensitive member is controlled by a controlling device to thereby control the surface temperature of the photosensitive member. The controlling device has two or more stages of set temperatures, and uses a high set temperature when the photosensitive member is used under an environment in which the absolute amount of water vapor is great.

2 Claims, 17 Drawing Sheets

AMBIENT TEMPERATURE 23°C
COMPARATIVE EXAMPLE

AMBIENT TEMPERATURE 27°C
COMPARATIVE EXAMPLE

AMBIENT TEMPERATURE 30 °C
COMPARATIVE EXAMPLE

COMPOUND EXAMPLE

| No. | COMPOUND EXAMPLE | No. | COMPOUND EXAMPLE |
|---|---|---|---|
| 1 |  | 11 |  |
| 2 |  | 12 |  |
| 3 |  | 13 |  |
| 4 |  | 14 |  |
| 5 |  | 15 |  |
| 6 |  | 16 |  |
| 7 |  | 17 |  |
| 8 |  | 18 |  |
| 9 |  | 19 |  |
| 10 |  | 20 |  |

| No. | COMPOUND EXAMPLE | No. | COMPOUND EXAMPLE |
|---|---|---|---|
| 21 |  | 31 |  |
| 22 |  | 32 |  |
| 23 |  | 33 |  |
| 24 |  | 34 |  |
| 25 |  | 35 |  |
| 26 |  | 36 |  |
| 27 |  | 37 |  |
| 28 |  | 38 |  |
| 29 |  | 39 |  |
| 30 |  | 40 |  |

FIG. 18

| | USE AMBIENT HUMIDITY [%] | USE AMBIENT TEMPERATURE [℃] | ABSOLUTE AMOUNT OF WATER VAPOR [g/m³] | INITIAL CONTROL DRUM SURFACE TEMPERATURE [℃] | DRUM SURFACE TEMPERATURE ON 200 SHEETS [℃] | ITB INITIAL SURFACE TEMPERATURE [℃] | VALUE OF CHANGE IN ELECTRIC POTENTIAL [V] | WITH OR WITHOUT OCCURRENCE OF SMEARED IMAGE |
|---|---|---|---|---|---|---|---|---|
| EMBODIMENT 1 | 5 | 23 | 1.03 | 33 | 30 | 24 | 7.6 | ○ |
| ↑ | 20 | 23 | 4.119 | 33 | 30 | 24 | 7.6 | ○ |
| ↑ | 40 | 23 | 8.239 | 33 | 30 | 24 | 7.6 | ○ |
| ↑ | 60 | 23 | 12.358 | 33 | 30 | 24 | 7.6 | ○ |
| ↑ | 70 | 23 | 14.418 | 33 | 30 | 24 | 7.6 | ○ |
| ↑ | 40 | 27 | 10.319 | 33 | 31 | 24 | 5.8 | ○ |
| ↑ | 60 | 27 | 15.478 | 45 | 40 | 32 | 7.6 | ○ |
| ↑ | 80 | 27 | 20.637 | 45 | 40 | 32 | 7.6 | ○ |
| ↑ | 60 | 30 | 18.241 | 45 | 42 | 35 | 5 | ○ |
| ↑ | 80 | 30 | 24.321 | 45 | 42 | 35 | 5 | ○ |
| EMBODIMENT 1,COMPARATIVE EXAMPLE A | 5 | 23 | 1.03 | 45 | 34 | 31 | 15.5 | ○ |
| ↑ | 20 | 23 | 4.119 | 45 | 34 | 31 | 15.5 | ○ |
| ↑ | 40 | 23 | 8.239 | 45 | 34 | 31 | 15.5 | ○ |
| ↑ | 60 | 23 | 12.358 | 45 | 34 | 31 | 15.5 | ○ |
| ↑ | 70 | 23 | 14.418 | 45 | 34 | 31 | 15.5 | ○ |
| ↑ | 40 | 27 | 10.319 | 45 | 40 | 33 | 7.6 | ○ |
| ↑ | 60 | 27 | 15.478 | 45 | 40 | 33 | 7.6 | ○ |
| ↑ | 80 | 27 | 20.637 | 45 | 40 | 33 | 7.6 | ○ |
| ↑ | 60 | 30 | 18.241 | 45 | 42 | 35 | 5 | ○ |
| ↑ | 80 | 30 | 24.321 | 45 | 42 | 35 | 5 | ○ |
| EMBODIMENTS 1-2 | 5 | 23 | 1.03 | 45 | 41 | 38 | 6.4 | ○ |
| ↑ | 20 | 23 | 4.119 | 45 | 41 | 38 | 6.4 | ○ |
| ↑ | 40 | 23 | 8.239 | 45 | 41 | 38 | 6.4 | ○ |
| ↑ | 60 | 23 | 12.358 | 45 | 41 | 38 | 6.3 | ○ |
| ↑ | 70 | 23 | 14.418 | 45 | 41 | 38 | 6 | ○ |
| ↑ | 40 | 27 | 10.319 | 45 | 43 | 40 | 3.7 | ○ |
| ↑ | 60 | 27 | 15.478 | 45 | 43 | 40 | 3.7 | ○ |
| ↑ | 80 | 27 | 20.637 | 45 | 43 | 40 | 3.7 | ○ |
| ↑ | 60 | 30 | 18.241 | 45 | 44 | 41 | 2.4 | ○ |
| ↑ | 80 | 30 | 24.321 | 45 | 44 | 41 | 2.4 | ○ |
| EMBODIMENT 1,COMPARATIVE EXAMPLE B | 5 | 23 | 1.03 | 40 | 30 | 28 | 16 | ○ |
| ↑ | 20 | 23 | 4.119 | 40 | 30 | 28 | 16 | ○ |
| ↑ | 40 | 23 | 8.239 | 40 | 30 | 28 | 16 | ○ |
| ↑ | 60 | 23 | 12.358 | 40 | 30 | 28 | 16 | ○ |
| ↑ | 70 | 23 | 14.418 | 40 | 30 | 28 | 16 | ○ |
| ↑ | 40 | 27 | 10.319 | 40 | 34 | 30 | 9.5 | △ |
| ↑ | 60 | 27 | 15.478 | 40 | 34 | 30 | 9.5 | △ |
| ↑ | 80 | 27 | 20.637 | 40 | 34 | 30 | 9.5 | × |
| ↑ | 60 | 30 | 18.241 | 40 | 37 | 31 | 5.5 | △ |
| ↑ | 80 | 30 | 24.321 | 40 | 37 | 31 | 5.5 | × |

FIG. 19

| FIG. 19A | FIG. 19B |
|---|---|

FIG. 19A

EMBODIMENT 1

| USE AMBIENT HUMIDITY [%] | ABSOLUTE AMOUNT OF WATER VAPOR [g] | INITIAL CONTROL DRUM SURFACE TEMPERATURE [°C] | DRUM SURFACE TEMPERATURE ON 200 SHEETS [°C] | ITB INITIAL SURFACE TEMPERATURE [°C] | VALUE OF CHANGE IN ELECTRIC POTENTIAL [V] |
|---|---|---|---|---|---|
| 5 | 1.03 | 33 | 30 | 24 | 7.6 |
| 20 | 4.119 | 33 | 30 | 24 | 5.6 |
| 40 | 8.239 | 33 | 30 | 24 | 4.9 |
| 60 | 12.358 | 33 | 30 | 24 | 4.5 |
| 70 | 14.418 | 33 | 30 | 24 | 4.4 |
| USE AMBIENT HUMIDITY [%] | ABSOLUTE AMOUNT OF WATER VAPOR [g] | INITIAL CONTROL DRUM SURFACE TEMPERATURE [°C] | DRUM SURFACE TEMPERATURE ON 200 SHEETS [°C] | ITB INITIAL SURFACE TEMPERATURE [°C] | VALUE OF CHANGE IN ELECTRIC POTENTIAL [V] |
| 40 | 10.319 | 33 | 31 | 24 | 3.5 |
| 60 | 15.478 | 45 | 40 | 33 | 6.4 |
| 80 | 20.637 | 45 | 40 | 33 | 6.3 |
| USE AMBIENT HUMIDITY [%] | ABSOLUTE AMOUNT OF WATER VAPOR [g] | INITIAL CONTROL DRUM SURFACE TEMPERATURE [°C] | DRUM SURFACE TEMPERATURE ON 200 SHEETS [°C] | ITB INITIAL SURFACE TEMPERATURE [°C] | VALUE OF CHANGE IN ELECTRIC POTENTIAL [V] |
| 60 | 18.241 | 45 | 42 | 35 | 4.0 |
| 80 | 24.321 | 45 | 42 | 35 | 3.9 |

FIG. 19B

EMBODIMENT 1 COMPARATIVE EXAMPLE A

| USE AMBIENT HUMIDITY [%] | ABSOLUTE AMOUNT OF WATER VAPOR [g] | INITIAL CONTROL DRUM SURFACE TEMPERATURE [℃] | DRUM SURFACE TEMPERATURE ON 200 SHEETS [℃] | ITB INITIAL SURFACE TEMPERATURE [℃] | VALUE OF CHANGE IN ELECTRIC POTENTIAL [V] |
|---|---|---|---|---|---|
| 5 | 1.03 | 45 | 34 | 31 | 15.5 |
| 20 | 4.119 | 45 | 34 | 31 | 14.4 |
| 40 | 8.239 | 45 | 34 | 31 | 14.0 |
| 60 | 12.358 | 45 | 34 | 31 | 13.8 |
| 70 | 14.418 | 45 | 34 | 31 | 13.7 |
| USE AMBIENT HUMIDITY [%] | ABSOLUTE AMOUNT OF WATER VAPOR [g] | INITIAL CONTROL DRUM SURFACE TEMPERATURE [℃] | DRUM SURFACE TEMPERATURE ON 200 SHEETS [℃] | ITB INITIAL SURFACE TEMPERATURE [℃] | VALUE OF CHANGE IN ELECTRIC POTENTIAL [V] |
| 40 | 10.319 | 45 | 40 | 33 | 6.5 |
| 60 | 15.478 | 45 | 40 | 33 | 6.4 |
| 80 | 20.637 | 45 | 40 | 33 | 6.3 |
| USE AMBIENT HUMIDITY [%] | ABSOLUTE AMOUNT OF WATER VAPOR [g] | INITIAL CONTROL DRUM SURFACE TEMPERATURE [℃] | DRUM SURFACE TEMPERATURE ON 200 SHEETS [℃] | ITB INITIAL SURFACE TEMPERATURE [℃] | VALUE OF CHANGE IN ELECTRIC POTENTIAL [V] |
| 60 | 18.241 | 45 | 42 | 35 | 4.0 |
| 80 | 24.321 | 45 | 42 | 35 | 3.9 |

FIG. 20

| | RESISTANCE OF UNDERCOAT LAYER [Ω cm] | FILM THICKNESS OF UNDERCOAT LAYER [μm] | AMOUNT OF CHARGE GENERATION MATERIAL [mg/m$^2$] | CHARGE GENERATION MATERIAL | HARDENING CONDITION |
|---|---|---|---|---|---|
| EMBODIMENT 1 | $1\times10^8$ | 0.4 | 130 | HoGaPc | ELECTRON IRRADIATION |
| EMBODIMENT 2 | ↑ | ↑ | ↑ | ↑ | ↑ |
| EMBODIMENT 3 | ↑ | ↑ | 90 | ↑ | ↑ |
| EMBODIMENT 4 | ↑ | ↑ | 107 | ↑ | ↑ |
| EMBODIMENT 5 | ↑ | ↑ | 130 | AZO PIGMENT | ↑ |
| EMBODIMENT 6 | ↑ | 0.6 | ↑ | HoGaPc | ↑ |
| EMBODIMENT 7 | $5\times10^8$ | 0.4 | ↑ | ↑ | ↑ |
| EMBODIMENT 8 | $1\times10^8$ | ↑ | ↑ | ↑ | ↑ |
| EMBODIMENT 9 | ↑ | ↑ | ↑ | ↑ | ↑ |
| COMPARATIVE EXAMPLE 1 | ↑ | ↑ | ↑ | ↑ | WITHOUT (FOUR LAYERS) |
| COMPARATIVE EXAMPLE 2 | ↑ | ↑ | ↑ | ↑ | ↑ |
| COMPARATIVE EXAMPLE 3 | ↑ | ↑ | ↑ | ↑ | ↑ |
| COMPARATIVE EXAMPLE 4 | ↑ | ↑ | ↑ | ↑ | ↑ |

ELECTROPHOTOGRAPHIC IMAGE FORMING APPARATUS

BACKGROUND OF THE INVENTION

1. Field of the Invention

The invention relates to an electrophotographic image forming apparatus using an electrophotographic printing method, and particularly to an electrophotographic image forming apparatus such as a copying machine, a printer or a facsimile apparatus.

2. Description of the Related Art

An electrophotographic photosensitive member (hereinafter suitably simply referred to as the "photosensitive member") is required to be provided with sensitivity, an electrical characteristic and further, an optical characteristic conforming to an electrophotographic process applied thereto. Particularly, in the photosensitive member for repetitive use, electrical and mechanical extraneous forces such as charging, exposure, development, transfer and cleaning are directly applied to the surface of the photosensitive member and therefore, durability to these extraneous forces is needed.

In an image forming apparatus of an electrophotographic type or an electrostatic recording type (such as, for example, a copying machine, a printer or a facsimile apparatus), a corona charger or a roller charger is often used as a charging device for uniformly charging (including a charge eliminating process) an image bearing member (a member to be charged) such as an electrophotographic photosensitive member or an electrostatic recording dielectric member to a predetermined polarity and predetermined potential.

As the electrophotographic photosensitive member, a photosensitive member using an organic material is popular from such advantages as a low price and productivity. The main current of the organic photosensitive member (OPC photosensitive member) is a photosensitive member of a function separate type comprising a charge generating layer containing an organic photoconductive dye and a pigment and a charge transport layer containing a photoconductive polymer and a low molecular organic photoconductive substance, the charge generating layer and the charge transport layer being laminated. Most of its surface layer comprises a molecule dispersed polymer having an organic photoconductive substance dispersed in a polymer, and its mechanical strength depends on the polymer, and with the recent high quality of image and longer life, its durability could not be said to be sufficient.

In contrast with this, in achieving the higher durability of the photosensitive member, it is known that the use of hardenable resin for the surface layer is effective (see Japanese Patent Application Laid-open No. H02-127652, Japanese Patent Application Laid-open No. H05-216249, and Japanese Patent Application Laid-open No. H07-72640). When hardenable resin is used for the surface layer, as compared with thermoplastic resin or the like, the mechanical strength increases and the surface layer becomes difficult to scrape off and also becomes difficult to injure, and thus the life of the photosensitive member becomes longer.

It is known that when hardenable resin is used for the surface layer of the photosensitive member, it is useful to use an electron ray as hardening means therefor, from the viewpoint of durability to the injury and scraping-off of the surface layer (see Japanese Patent Application Laid-open No. 2000-66425).

Therefore, use is made of a photosensitive member having a surface layer hardened by an electron ray and an image forming apparatus in which the photosensitive member is charged by a corona charging method is constructed, whereby there can be established an electrophotographic system which can greatly extend the life of the photosensitive member against the injury and scraping-off.

On the other hand, in an image forming apparatus, it is known that it is useful for the obtainment of a higher quality of image to make the film thickness of the charge transport layer, or the protective layer and the charge transport layer of the photosensitive member small (see Japanese Patent Application Laid-open No. H08-272197).

Accordingly, to achieve higher durability and a higher quality of image in the image forming apparatus, it becomes necessary to provide a photosensitive member having a photosensitive member surface layer hardened by an electron ray and in which the film thickness of a charge transport layer or a protective layer and the charge transport layer is small.

However, in a case where use is made of a photosensitive member in which the film thickness of a surface layer (a protective layer or a charge transport layer is small, when continuous sheet supply endurance was effected under a low humidity environment, there arose the problem that image density lowered as the number of sheets was increased. Also, this phenomenon has dependency on the drum surface temperature under a low humidity environment, and exhibited the tendency of becoming more remarkable when the temperature was low.

Also, when hardenable resin is used for the surface layer of the photosensitive member, the mechanical strength thereof increases and the surface layer becomes difficult to scrape off and the life of the photosensitive member becomes longer, while on the other hand, the reformability of the surface of the photosensitive member lacks, and image deletion resulting from a discharge product or the like adhering to the surface layer having absorbed humidity becomes liable to occur.

The problem of image deletion has heretofore been prevented from arising by maintaining the surface temperature of the photosensitive member at a high temperature under a high humidity environment. Accordingly, if even under an environment of low humidity in which a density fluctuation occurs, the surface temperature of the photosensitive member is likewise maintained at a high temperature, the both problems of density fluctuation and image deletion will be solved.

However, in an image forming apparatus particularly having a construction in which an intermediate transfer belt (rotary transfer member) which is a belt-shaped intermediate transfer member contacts with a photosensitive member at a primary transferring position, or a construction in which a predetermined amount of wind is blown against the photosensitive member during sheet supply to effectively remove a discharge product in a primary charger, the heat of the surface of the photosensitive member is gradually taken away from the timing at which sheet supply has been started, and the temperature of the photosensitive member falls.

There will arise no problem if the environment of use is under a high temperature, but the fall of the temperature of the photosensitive member is particularly vehement in an environment of an ordinary temperature of the order of 20-25° C. Thus, by setting the surface temperature of the photosensitive member at the initial stage of sheet supply at a high temperature, it is possible to maintain the temperature of the photosensitive member at a temperature whereat a density fluctuation is little and image deletion does not occur. However, when the fall of the temperature of the photosensitive member is great, the amount of charge generation of the photosensitive member fluctuates, and this becomes the factor of the fluctuation of density.

A heater for adjusting the drum temperature effects the simple control of charging over so as to become OFF if the value detected by a drum temperature sensor is high relative to a set target temperature, and to become ON if the aforementioned value is low relative to the set target temperature. However, even if the drum surface temperature is judged to be low and the heater is in its operative state, the amount of electric power during sheet supply is limited, and when it is limited to a low level, it becomes impossible to maintain the target temperature.

SUMMARY OF THE INVENTION

It is an object of the present invention to provide an electrophotographic image-forming apparatus which can form a good image irrespective of the fluctuation of an ambient environment.

It is another object of the present invention to provide an electrophotographic image forming apparatus having a photosensitive member of which the surface layer contains a compound of which at least one polymerization functional group has been hardened by electron irradiation, image forming means for forming a toner image on the photosensitive member, heating means for heating the photosensitive member, temperature detecting means for detecting the temperature of the photosensitive member, controlling means for controlling the operation of the heating means in accordance with the output of the temperature detecting means so that the temperature of the photosensitive member may maintain a target temperature, temperature/humidity detecting means for detecting the temperature/humidity of atmosphere, and setting means for setting the target temperature in accordance with the output of the temperature/humidity detecting means.

It is still another object of the present invention to provide an electrophotographic image forming apparatus having a photosensitive member of which the surface layer contains a compound of which at least one polymerization functional group has been hardened by electron irradiation, image forming means for forming a toner image on the photosensitive member, heating means for heating the photosensitive member, and controlling means for controlling the temperature of the photosensitive member, wherein when the boundary value of an absolute amount of water vapor is defined as 12-16 $g/m^3$, if the absolute amount of water vapor is less than the boundary value, the temperature of the photosensitive member is maintained at 28-35° C., and if the absolute amount of water vapor is equal to or greater than the boundary value, the temperature of the photosensitive member is maintained at 37-55° C.

Other objects of the present invention will become apparent from the following detailed description when read with reference to the drawings.

BRIEF DESCRIPTION OF THE DRAWINGS

FIG. 18 illustrates the characteristics of the photosensitive members in embodiments and the comparative example.

FIG. 19 is comprised of FIGS. 19A and 19B enlarge and illustrates a portion of FIG. 18.

FIG. 20 illustrates the characteristics of photosensitive members in Embodiments 1 to 9 and Comparative Examples 1 to 4.

DESCRIPTION OF THE PREFERRED EMBODIMENTS

Figure 1:
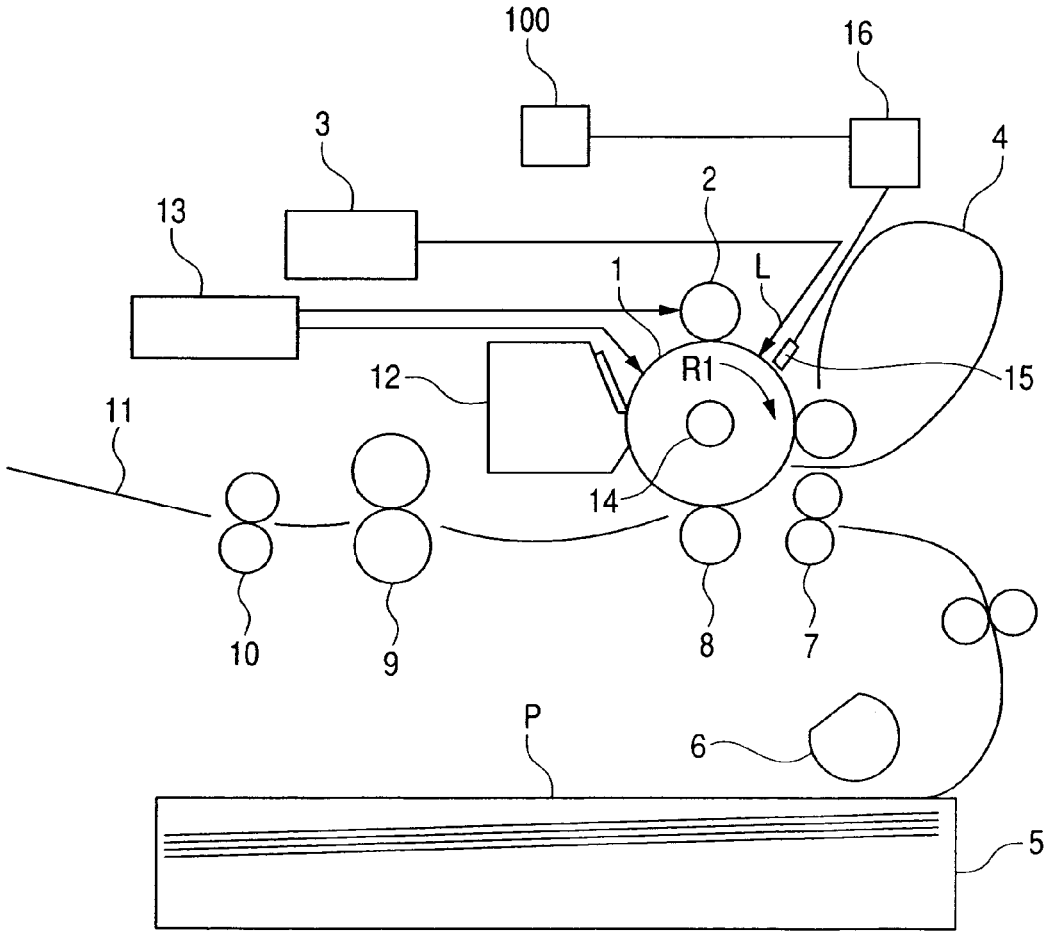
FIG. 1 schematically shows the construction of an image forming apparatus to which the present invention can be applied.

Description will hereinafter be made of an image forming apparatus to which the present invention can be applied.

An electrophotographic photosensitive member (hereinafter referred to as the "photosensitive member") used in the present invention will first be described in detail. In the present embodiment, a case where as will be described later with reference to FIG. 1, a photosensitive drum 1 is used as the photosensitive member will be described as an example.

A photosensitive layer used in the present invention is of a laminated type functionally separated into a charge generating layer containing a charge generating substance, and a charge transport layer containing a charge transport substance. It is also possible to adopt a construction in which a surface layer as a protective layer is further formed on this photosensitive layer of the laminated type.

In the present invention, the surface layer of the photosensitive member can contain a compound in which at least one polymerization functional group is polymerized or cross-linked, and is hardened.

As the compound for the surface layer in which at least one polymerization functional group can be polymerized or cross-linked and hardened, compounds having an unsaturated polymerization functional group in a molecule are preferable from the viewpoints of the highness of reaction, the highness of a kinetics, the highness of hardness achieved after hardening, etc., and among them, compounds having an acryl group, a methacryl group and a styrene group are particularly preferable.

The compounds having an unsaturated polymerization functional group in the present invention are broadly divided into a monomer and an oligomer. The monomer refers to a compound free of the repetition of a structural unit having an unsaturated polymerization functional group, and relatively small in molecular weight, and the oligomer is a polymer in which the number of repetitions of the structural unit having the unsaturated polymerization functional group is of the order of 2-20. A macronomer having an unsaturated polymerization functional group only at the end of the polymer or the oligomer is also usable as a hardenable compound for the surface layer of the present invention.

Also, the compounds having the unsaturated polymerization functional group in the present invention may preferably be charge transport compounds in order to satisfy a charge transporting function necessary as the surface layer. Above all, they may more preferably be unsaturated polymerization compounds having a positive hole transporting function.

The procedure of forming the surface layer becomes the procedure of dissolving a compound for the surface layer which can be polymerized or cross-linked and hardened, using a coating solution contained therein, applying it by an immersion coating method, a spray coating method, a curtain coating method, a spin coating method or the like, and hardening this by the above-described hardening means. To produce photosensitive members efficiently and in a great deal, the immersion coating method is best, and in the present invention as well, the immersion coating method is possible.

As the hardening means for the surface layer, the use of an electron ray is suitable in that hardening within a short time is possible and this leads to high productivity and that sufficient hardness can be exhibited.

In this case, the radiation used is an electron ray and γ ray. When electron irradiation is to be effected, any one of a scanning type, an electron curtain type, a broad beam type, a pulse type and a laminar type can be used as an accelerator. When an electron ray is to be irradiated, in realizing an electrical characteristic and durable performance in the photosensitive member of the present invention, the irradiating condition thereof is such that the accelerating voltage is preferably 250 kV or less, and optimally 150 kV or less. Also, the amount of irradiation is preferably a range of $1\times10^4$–$1\times10^6$ Gy, and more preferably a range of $3\times10^4$–$5\times10^5$ Gy. If the accelerating voltage exceeds the above-mentioned range, the damage by electron irradiation to the characteristic of the photosensitive member tends to increase. Also, when the amount of irradiation is smaller than the above-mentioned range, hardening is liable to become insufficient, and when the amount of irradiation is great, the deterioration of the characteristic of the photosensitive member is liable to occur and therefore, care need be taken.

Description will now be made of the layer construction of the photosensitive layer of the photosensitive member in the present invention.

As a supporting member for the photosensitive member, use can be made of any material having electrical conductivity, and mention may be made, for to example, of a metal such as aluminum, copper, chromium, nickel, zinc or stainless steel, an alloy formed into a drum or sheet shape, metal foil of aluminum or copper laminated on plastic film, aluminum, indium oxide or tin oxide vapor-deposited on plastic film, a metal to which an electrically conductive substance is applied singly or with binding resin to thereby provide an electrically conducting layer, plastic film or paper.

In the present invention, an undercoat layer having a barrier function and an adhesively securing function is provided on the electrically conductive supporting member.

The undercoat layer is formed for the improvement in the adhesiveness of the photosensitive layer, the improvement in a coating property, the protection of the supporting member, the covering of a defect on the supporting member, the improvement in a charge injecting property from the photosensitive layer, the protection against the electrical destruction of the photosensitive layer, etc. As the material of the undercoat layer, use can be made of polyvinyl alcohol, poly-N-vinylimidazole, polyethylene oxide, ethyl cellulose, ethylene-acrylic acid copolymer, casein, polyamide, N-methoxymethylated hexa-nylon, copolymer nylon, glue or gelatin. These are dissolved into a solvent suited therefor and are applied onto the supporting member or an electrically conductive layer formed on the supporting member. The film thickness in that case may preferably be 0.1-2.0 μm, and particularly in the present invention, may preferably be 0.1-0.5 μm.

In the present invention, the resistivity of the undercoat layer is $1\times10^{11}$ Ω·cm or less by measurement under an environment of temperature 23° C. and humidity 55%.

As the charge generating substance used for the charge generating layer, mention may be made of selenium tellurium, pyrylium, a thiapyrylium dye, phthalocyanine compound having various central metals and crystal systems, specifically, crystal types such as, for example, α, β, γ, ϵ and X type, anthoantron pigment, dibenzpyrenequinone pigment, pyranetron pigment, tris-azo pigment, dis-azo pigment, monoazo pigment, indigo pigment, quinacrydon pigment, asymmetric quinocyanine pigment, quinocyanine or amorphous silicone.

The charge generating layer is formed by well dispersing one of the above-mentioned substances together with 0.3 to 4 times as great an amount of binding resin and solvent by means such as a homogenizer, ultrasonic dispersion, a ball mill, a vibration ball mill, a sand mill, an attriter or a roll mill, applying dispersing liquid thereto, and drying them, or is formed as film of a single composition such as the vapor-deposited film of one of the above-mentioned charge generating substances. The film thickness thereof may preferably be 5 μm or less, and particularly preferably be within a range of 0.1 to 2 μm.

As what can be used as the binding resin, mention may be made of polymer or copolymer of vinyl compounds such as styrene, vinyl acetate, vinyl chloride, ester acrylate, methacrylic acid ester, vinylidene fluoride, and trifluoroethylene, polyvinyl alcohol, polyvinyl acetal, polycarbonate, polyester, polysulfone, polyphenylene oxide, polyurethane, cellulose resin, phenol resin, melamine resin, silicon resin, epoxy resin or the like.

In the present invention, it is preferable that the ratio of the charge generating substance and the binding resin be within a range of 1/2 to 5/1. If the ratio is smaller than 1/2, the resin percentage becomes great, whereby there arise such problems as aggravated sensitivity and the rise of electric potential in endurance due to the accumulation of charges becoming liable to occur in the charge generating layer. On the other hand, if the ratio becomes greater than 5/1, the percentage of the charge generating substance is great and therefore, when an electric field is applied to the photosensitive layer, the injection of charges becomes liable to occur from a layer underlying the charge generating layer, and in a reversal developing system, such problems as fog and black dots arise on the white ground portion of an image.

In the present invention, the charge transport layer or the protective layer can be the surface layer.

In a case where the surface layer is the protective layer, the charge transport layer can be formed by applying and drying a solution consisting of a suitable charge transport substance, e.g. a high molecular compound having a heterocyclic ring or a condensation polycyclic aromatic, such as poly-N-vinyl carbazole or polystyryl anthracene, a heterocyclic ring compound such as pyrazoline, imidazole, oxazole, triazole or carbazole, a triaryle alkane dielectric material such as triphenylmethane, a triaryl amine derivative such as triphenyl amine, or a low molecular compound such as a phenylene diamine derivative, an N-phenyl carbazole derivative, a stylbene derivative or a hydrazone derivative dispersed/dissolved in a solution together with suitable binding resin (which can be selected from among the aforedescribed resins for the charge generating layer) by the aforedescribed known method. As regards the ratio of the charge transport substance and the binding resin in this case, when the total weight of the two is 100, the weight of the charge transport substance should desirably be 30-100, and is suitably selected preferably within a range of 50 to 100. If the amount of the charge transport substance is equal to or less than that, the charge transporting capability is reduced and such problems as a reduction in sensitivity and the rise of residual electric potential arise.

The total film thickness of the charge transport layer and the protective layer should preferably be 22 μm or less from the viewpoints of a higher quality of image. In this case, the film thickness of the charge transport layer should preferably be within a range of 5 to 17 μm, the film thickness of the protective layer should preferably be within a range of 2 μm to 10 μm, and should more preferably be within a range of 0.5 to 6.0 μm.

In a case where the charge transport layer is the surface layer, it is popular to apply a solution containing the aforedescribed positive hole transport compound, and thereafter polymerize/hardening react it, but it is also possible to form the surface layer by the use of a material in which a solution containing this positive hole transport compound is reacted in advance to thereby obtain a hardened material, which is thereafter dispersed or dissolved again in a solution. As a method of applying these solutions, there is known, for example, an immersion coating method, a spray coating method, a curtain coating method or a spin coating method, but the immersion coating method is preferable from the viewpoints of efficiency and productivity.

The surface layer in the present invention can contain fluorine atom containing resin particles therein.

As the fluorine atom containing resin particles, it is preferable to suitably select one or more kinds from among tetrafluoroethylene resin, ethylene trifluoride chloride resin, hexafluoroethylene propylene resin, vinyl fluoride resin, vinylidene fluoride resin, ethylene difluoride dichloride resin and copolymers of these, and tetrafluoroethylene resin and vinylidene fluoride resin are particularly preferable. The molecular weight and particle diameter of the resin particles can be suitably selected and are not particularly restricted.

The rate of the fluorine atom containing resin particles in the aforedescribed surface layer should preferably be 5-70% by weight to the total weight of the surface layer, and more preferably be 10-60% by weight. If the rate of the fluorine atom containing resin particles is greater than 70% by weight, the mechanical strength of the surface layer is liable to lower, and if the rate of the fluorine atom containing resin particles is smaller than 5% by weight, the mold releasability of the surface of the surface layer, and the wear resistance and injury resistance of the surface layer may become insufficient.

In the present invention, with a view to further improve a dispersing property, a binding property and weather resistance, an additive such as a radical supplement agent or an antioxidant may be added into the aforedescribed surface layer.

The inventors consider the mechanism of image density reduction in continuous sheet supply endurance under a low-humidity environment which is the problem of the present invention as follows.

The inventors have confirmed that this image density reduction is attributable to the rise of the surface potential of the photosensitive member due to continuous sheet supply. Also, the inventors have confirmed that in an environment wherein the image forming apparatus (electrophotographic apparatus) is placed, the image density reduction has a great correlation with the temperature of the environment, and that it is a phenomenon remarkably appearing in the case of an environment in which the absolute humidity (hereinafter referred to as the absolute amount of water vapor) is low.

So, in the present image forming apparatus, there is provided an environment sensor 100 for detecting the ambient temperature and relative humidity. A control device CPU 16 to which signals corresponding to the temperature and relative humidity detected by this environment sensor 100 have been inputted calculates an absolute amount of water vapor on the basis of these two signals. That is, various kinds of control which will be described later are effected on the basis of the absolute amount of water vapor calculated in this manner.

Further, the inventors have confirmed that in a case where an electron ray is used as the hardening means for the surface layer, even if the electron ray is applied with a minimum degree of intensity necessary for the hardening of the surface layer, the electron ray is transmitted through the surface layer and reaches a base.

From these phenomena, the inventors have thought that the main cause of this problem is the degeneration of the undercoat layer which is a portion in which water vapor is liable to contribute to the movement of the charges in the photosensitive layer, or the undercoat layer/the charge generating layer and the interface area of the charge generating layer, by the electron ray. That is, the inventors have thought that it is the cause of the rise of the surface potential that in the photosensitive layer, it has become difficult for the movement/injection of the charges in the layer which is most liable to be affected by water vapor and in which ion conduction is dominant and/or ("and/or" is used in the meaning of "at least one", and this also holds true in the following) the interface thereof to be effected smoothly. In the continuous sheet supply endurance, the next charging/exposing sequence is carried out in a state in which the accumulation of charges has occurred in that layer and/or the interface thereof, and that process is carried out repetitively and therefore, the surface potential of the photosensitive member has gradually risen.

Figure 2:
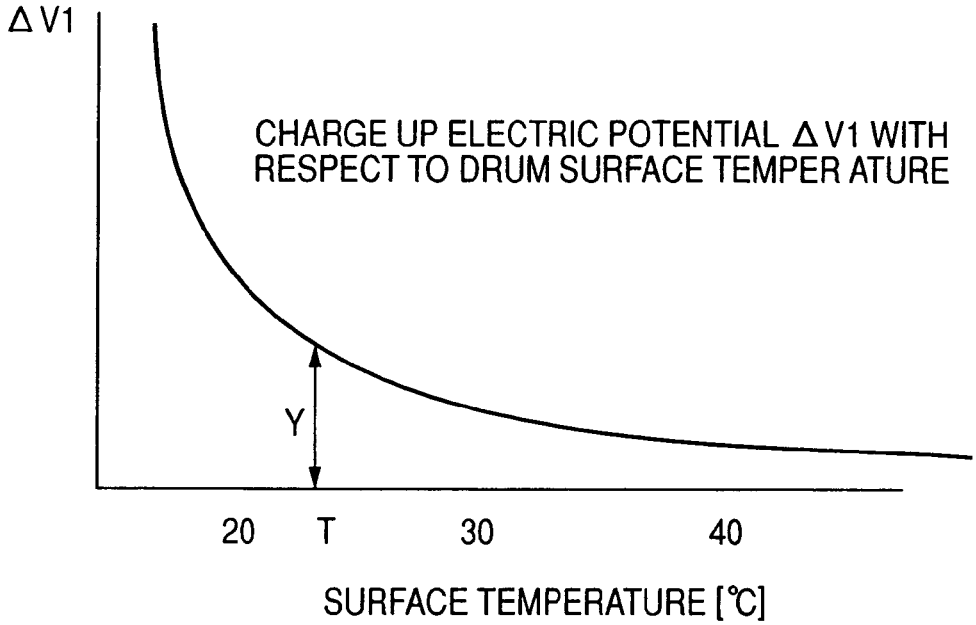
FIG. 2 is a graph illustrating the relation between a drum surface temperature and the electric potential of an exposed portion.

The inventors has found as a result of their studies earnestly repeated that to enable the movement/injection of charges to be properly effected without stagnation in the photosensitive layer degenerated by the electron ray, it is necessary to control the temperature of the photosensitive member under various photosensitive member installation humidity conditions. The relation of the rise of the electric potential of the exposed portion to the surface temperature and humidity of the photosensitive member has become such as shown in FIG. 2. Accordingly, by the construction of the present invention in which the surface temperature of the photosensitive member irradiated with an electron ray is controlled so as to be satisfied to a level equal to or less than a predetermined electric potential fluctuation relative to the humidity of the external environment being provided in the image forming apparatus, the movement/injection of charges in the photosensitive layer is effected smoothly, and in continuous sheet supply endurance, the rise of the surface potential of the photosensitive member is suppressed. Thus, there can be provided an image forming apparatus which can continue to form images stable in image density.

Figure 3:
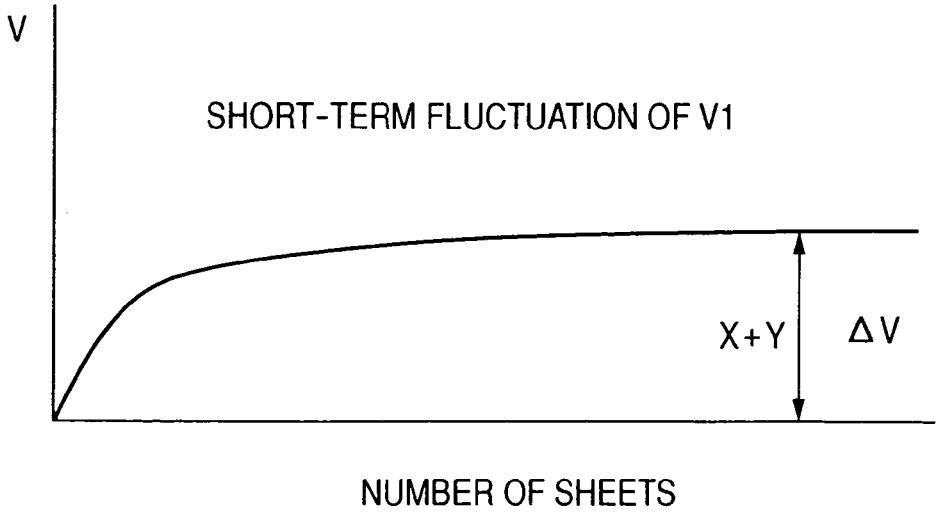
FIG. 3 is a graph illustrating the relation between the number of supplied sheets and the electric potential characteristic of the exposed portion.
Figure 4:
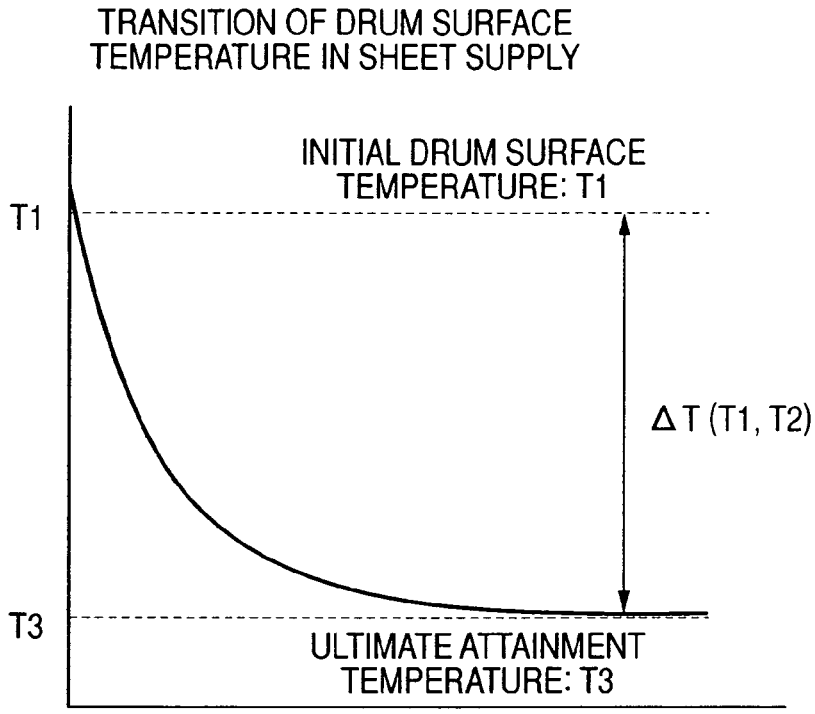
FIG. 4 is a graph illustrating the relation between the number of supplied sheets and the drum surface temperature.

However, when the surface temperature of the drum (the photosensitive drum as the photosensitive member) was set at a high temperature under an ordinary-temperature low-humidity environment, the drum exhibited such an exposed portion electric potential characteristic as shown in FIG. 3 after the start of sheet supply, and the then surface temperature of the drum exhibited such a transition as shown in FIG. 4. That is, the ultimate attainment temperature of the drum surface after the start of sheet supply is 33° C. and therefore, when the characteristic of FIG. 2 is taken into consideration, the fluctuation of the electric potential of the, exposed portion ought to be slight, but actually there was a rise as great as about 20V.

Figure 5:
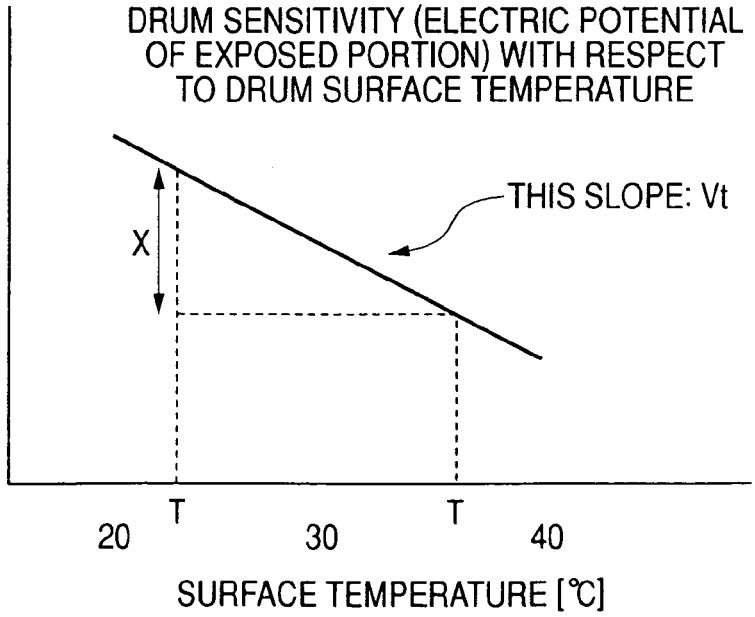
FIG. 5 is a graph illustrating the relation between the drum surface temperature and the electric potential of the exposed portion.

This reflects the fact that the characteristic of the amount of charge generation by the exposure of the drum is such that at a high temperature, more charges are generated and therefore, the electric potential of the exposed portion is lower at the start of sheet supply, and when the temperature of the drum is lowered by the sheet supply and the sensitivity thereof is reduced, the electric potential of the exposed portion rises. FIG. 5 shows the characteristic of the electric potential of the exposed portion of the photosensitive drum used this time relative to the temperature thereof. According to this, it is known that the electric potential is lowered by the order of 2V per once.

Figure 6:
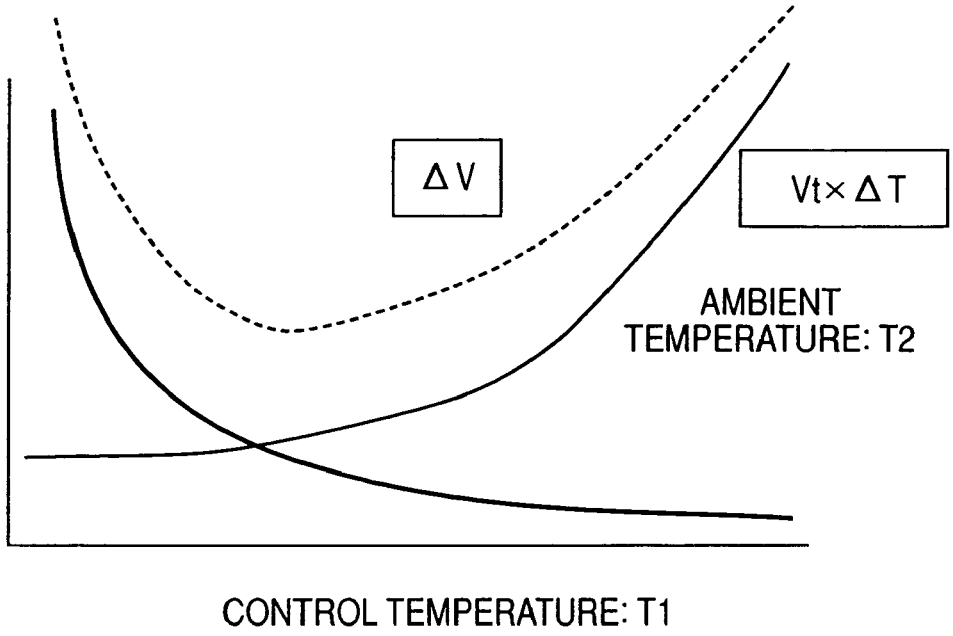
FIG. 6 is a graph illustrating the relation between a drum surface control temperature and an increase in electric potential.
Figure 7:
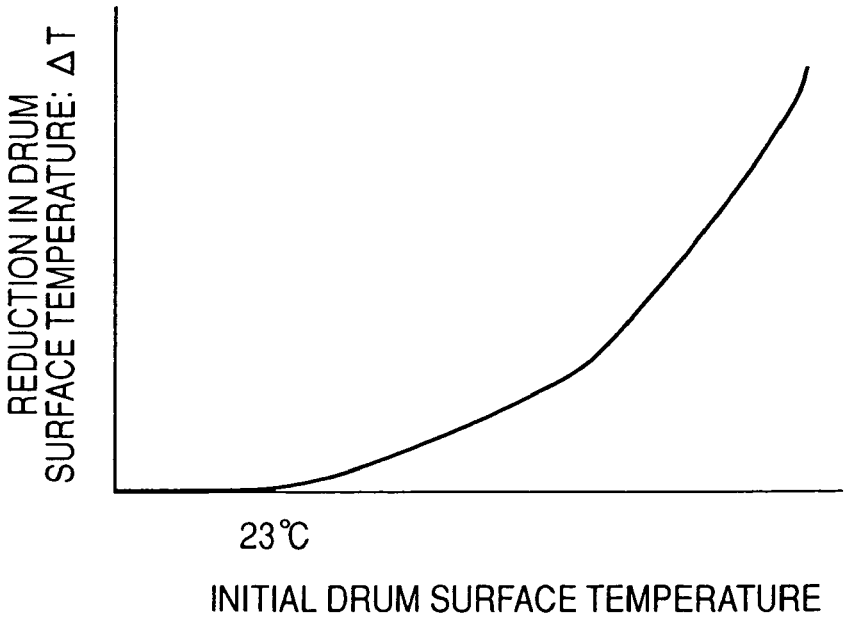
FIG. 7 is a graph illustrating the relation between an initial drum surface temperature and a reduction in the drum surface temperature.

Accordingly, a rise of 18V (X in FIG. 5) is added by the lowering of the surface temperature of the drum of 9° C. by sheet supply. After all, the total rise of the electric potential is determined by both of the rise (X in FIG. 5) by the temperature characteristic of the photosensitive member and the rise (Y in FIG. 2) of the electric potential in a low-humidity environment. FIG. 6 typically shows the line of ΔV in which the line of a change in temperature in FIG. 5 multiplied by a change Vt in sensitivity per 1° C. and the line of the rise of electric potential at the ultimate attainment temperature by sheet supply which is determined by the characteristic of FIG. 5 are added together in a certain humidity environment when the axis of abscissas is the drum surface control temperature. The minimum point of the addition line is the ideal set surface temperature of the drum. So, the result of the measurement of the amount of lowering of the temperature after sheet supply at each initial drum surface temperature under a use environment of 23° C. became such as shown in FIG. 7. That is, the more approximate to 23° C. is the initial temperature, the less is the change in temperature after sheet supply and therefore, in a low-humidity environment, it is necessary to set the temperature so that the total rise of electric potential may become small, and in a high-humidity environment, it is necessary to maintain the temperature at a temperature whereat image deletion does not occur.

So, in an embodiment which will be described later, the initial drum surface temperature was determined as follows.

When as shown in FIG. 1, the drum surface (set) temperature during the image formation waiting time is defined as T1, and the temperature of the periphery (atmosphere) of the photosensitive member in the apparatus is defined as T2, and the difference in the electric potential of the exposed portion per change of 1° C. in the drum surface temperature is defined as Vt (which will hereinafter be referred to as the temperature characteristic of the photosensitive member), and the short-term rise (charge-up potential) of the electric potential during the image forming operation which depends on the drum surface temperature T is defined as ΔV1 (T), and the ultimate attainment temperature of the drum surface when the drum surface temperature has lowered during the image forming operation is defined as T3, and T1-T3 is defined as ΔT (T1, T2), the control temperature of the drum surface temperature by a heater provided in the drum is set so that the value of $$\Delta V=\Delta T(T1, T2)\times Vt+\Delta V1(T2)$$

may be equal to or less than a target electric potential fluctuation.

In the present embodiment, when the absolute amount of water vapor of the atmosphere obtained from the output of the environment sensor 100 is less than a predetermined boundary value, the surface temperature of the photosensitive drum is maintained at a high temperature, and the absolute amount of water vapor of the atmosphere is equal to or greater than the predetermined boundary value, the surface temperature of the photosensitive drum is maintained at a low temperature.

It is preferable that this boundary value of the absolute amount of water vapor of the atmosphere be set to 12-16 g/m$^3$. In the present embodiment, the control device 16 controls the operation of the heater 14, whereby when the absolute amount of water vapor is less than 12-16 g/m$^3$, the surface temperature of the photosensitive drum is maintained at 28-35° C. Preferably, when the absolute amount of water vapor is less than 12-16 g/m$^3$, the surface temperature of the photosensitive drum may be maintained at 30-33° C.

On the other hand, when the absolute amount of water vapor is equal to or greater than 12-16 g/m$^3$, the surface temperature of the photosensitive drum is maintained at 37-55° C. Preferably, when the absolute amount of water vapor is equal to or greater than 12-16 g/m$^3$, the surface temperature of the photosensitive drum may be maintained at 40-50° C.

Specifically, when the absolute amount of water vapor is less than 14 g/m$^3$, the surface temperature of the photosensitive drum is set at 33° C., and when the absolute amount of water vapor is equal to or greater than 14 g/m$^3$, the surface temperature of the photosensitive drum is set at 45° C.

By adopting the construction as described above, there can be provided an image forming apparatus which can continue to form images stable in image density.

That is, the present invention proposes the construction of an image forming apparatus which can eliminate the influence of the electron ray necessary for the hardening of the surface layer for a higher quality of image and higher durability upon the photosensitive layer.

Description will now be made of the image forming apparatus of the present invention provided with the photosensitive member and the corona charger made in the manner described above.

FIG. 1 schematically shows the construction of an image forming apparatus to which the present invention can be applied. The image forming apparatus shown in FIG. 1 is provided with a photosensitive drum as the aforedescribed photosensitive member 1. The photosensitive member 1 is rotatively driven at a predetermined process speed (peripheral speed) in the direction indicated by the arrow R1. The photosensitive member 1 is subjected to uniform charging of predetermined negative electric potential on the outer peripheral surface (the surface) thereof by a corona charger (primary charging means) 2 in the rotation process thereof. As the charging bias at this time, use is made of a superimposed voltage comprising a DC voltage and an AC voltage superimposed one upon the other. The surface of the photosensitive member 1 after charged is subjected to optical image exposure L (such as slit exposure or laser beam scanning exposure) by an exposing device (exposing means) 3. Thereby, an electrostatic latent image corresponding to the exposure image is sequentially formed on the surface of the photosensitive member.

This charging method using the corona charger, as a charging method using a charging roller, i.e., a roller charging method in which an AC component is included in a voltage applied, has the advantage that the electrical deterioration of the surface of the photosensitive member can be reduced. As compared with corona charging in the corona charging method, in the case of roller charging, the total amount of generation of discharge products is markedly small. In the roller charging method, however, a discharge current flows through a minute space between the surface of the photosensitive member and the surface of the charging roller, and particles such as electrons and ions of very high energy repeat their collision against the surface of the photosensitive member. Therefore, the molecular chains in the surface of the photosensitive member are divided in sections, and the surface of the photosensitive member becomes liable to be shaved and is also liable to be injured. That is, the surface layer of the photosensitive member, when used in the roller charging, receives electrical damage and mechanical damage. In contrast, the corona charging is a charging method utilizing mild discharge and therefore, electrical damage is very little and mechanical damage becomes dominant. That is, the corona charging is at advantage for the higher durability of the photosensitive member.

The electrostatic latent image is then developed by a developing device (developing means) 4 with a toner and becomes a toner image. This toner image is sequentially transferred to a transfer material P fed from a sheet supply cassette 5 to a transferring portion between the photosensitive member 1 and a transfer roller (transferring means) 8 through a sheet feeding roller 6 and registration rollers 7 in synchronism with the rotation of the photosensitive member 1. The transfer material 4 having received the transfer of the toner image is separated from the surface of the photosensitive member, is introduced into a fixing device (fixing means) 9 and has the toner image thereon fixed on the surface thereof, and thereafter is discharged as a copy onto a sheet discharging tray 11 outside an image forming apparatus main body (not shown) by sheet discharging rollers 10. On the other hand, the photosensitive member 1 after the transfer of the toner image has any toner residual on the surface thereof (untransferred residual toner) removed by a cleaning device (cleaning means) 12, is subjected to a charge eliminating process by an ante-exposing device (ante-charging exposing means) 13 and is repetitively used for image formation.

In the above-described image forming apparatus shown in FIG. 1, a temperature raising device 14 is provided in the interior of the photosensitive member 1. Also, in the image forming apparatus main body, there are provided a temperature sensor (temperature detecting means) 15 for measuring the surface temperature of the photosensitive member 1, and controlling means (system) 16 for controlling the temperature raising device 14 on the basis of the result of measurement by the temperature sensor 15.

In the present invention, the surface temperature of the photosensitive member is always controlled within a range lower than 55° C.

This is because if the surface temperature of the photosensitive member becomes equal to or higher than 55° C., the fluidity of the toner becomes remarkably bad and there arise other problems such as the deterioration of a developing property, the deterioration of a cleaning property and the deterioration of a transferring property.

As the image forming apparatus, plural ones of the constituents such as the photosensitive member 1, the charging roller 2, the developing device 4 and the cleaning device 12 may be integrally combined as a process unit, and this process unit may be made detachably mountable on the image forming apparatus main body. For example, the photosensitive member 1 and the cleaning device 12 may be made integral with each other to thereby constitute a process unit, which may be made into a detachably mountable construction by the use of a guide member such as the rail of the image forming apparatus main body. At this time, design may be made such that at least one of the charging roller 2 and the developing device 4 is included on the process unit side.

The means necessary for carrying out an ordinary electrophotographic process, such as the charging means, the exposing means, the transferring means and the cleaning means in the present invention are restricted in no way, but in an apparatus construction, it is also possible to adopt the construction of an image forming apparatus in a cleanerless system excluding, for example, the cleaning means.

Also, in an apparatus of a construction using an intermediate transfer member (intermediate transfer unit), when the intermediate transfer member after the image forming apparatus main body has been left unused is cold, the heat of the drum surface is taken away by the intermediate transfer member during sheet supply, and the lowering of the temperature becomes great. This becomes the cause of electric potential fluctuation in a low-humidity environment, and becomes the cause of image deletion in a high-humidity environment.

Figure 8:
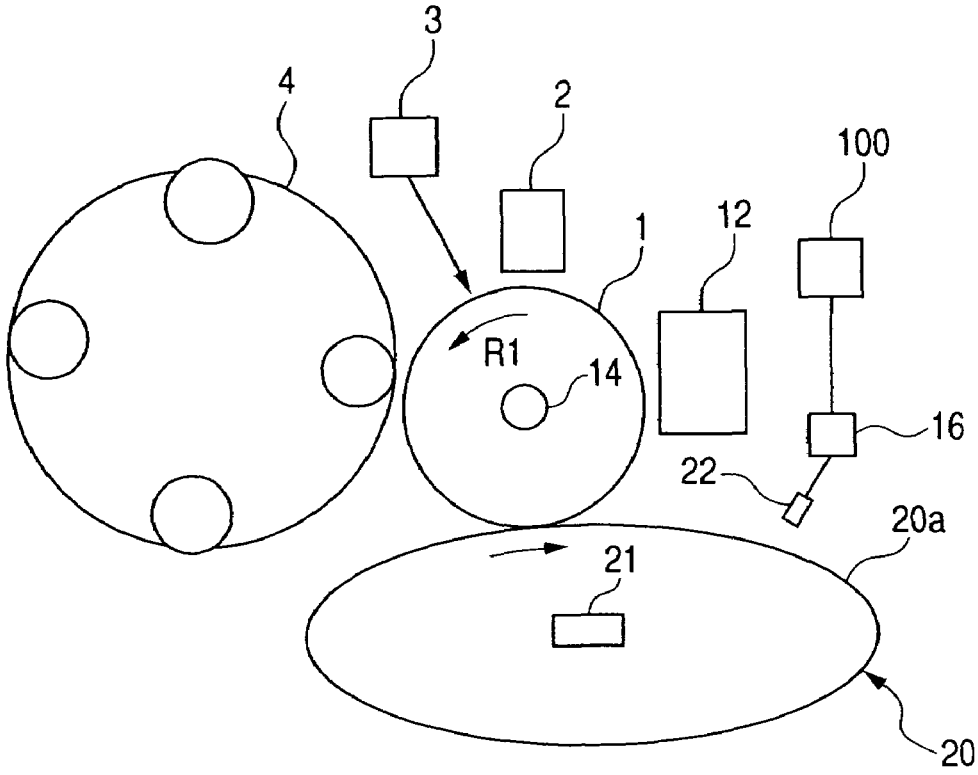
FIG. 8 schematically shows the construction of an image forming apparatus using an intermediate transfer belt.

So, in an image forming apparatus provided with an intermediate transfer unit 20 having an intermediate transfer belt (intermediate transfer member) 20*a*, like an image forming apparatus shown in FIG. 8, it is also effective to provide an auxiliary heater 21 discretely in the intermediate transfer unit 20 to thereby maintain the surface temperature of the intermediate member of the intermediate transfer belt (ITB) 20*a* at a predetermined temperature or higher when the image forming apparatus main body is left unused. In this case, design is made such that the surface temperature of the intermediate transfer member is detected by a temperature sensor 22, and on the basis of the result of the detection, a control device (CPU) 16 controls the surface temperature of the intermediate transfer member. In the example shown in FIG. 8, a corona charger 2 is used as charging means.

The present invention is applied to the above-described image forming apparatus and besides, can be widely used in the field of applied electrophotography such as, for example, a laser beam printer, a CRT printer, an LED printer, a liquid crystal printer and a laser process machine, as an electrophotographic apparatus provided with the above-described electrophotographic photosensitive member 1. The present invention can also be constituted by a facsimile apparatus having receiving means for receiving image information from an image forming apparatus and a remote terminal.

The present invention is particularly effective if design is made such that in a case where the wavelength of the light source of the ante-exposing device 13 has a peak at 400-800 nm, the illuminance on the surface of the photosensitive member is 1 lux·sec. or greater and 10 lux·sec. or less, and the electric potential of the image exposed portion at charging potential of 400-900 V is 70-400 V by charging means (e.g. the charging roller 2 in FIG. 1 or the corona charger 2 in FIG. 8), the photosensitive member 1 is a photosensitive member 1 rotated at 20-100 rpm and in which the electric potential of the image exposed portion rises by 10 V or more under an environment having an absolute amount of water vapor of 0-5 $g/m^2$ by a rotation exposing operation, and the control device (CPU) 16 has two or more stages of set temperatures set by the use environment of the photosensitive member 1.

The present invention will hereinafter be described more specifically with respect to some embodiments thereof and comparative examples.

Embodiment 1

Method of Manufacturing the Photosensitive Member

Hereinafter, "part" in the embodiment means "part by mass".

The photosensitive member (photosensitive drum) 1 of the present-invention shown in FIG. 1 was manufactured in the following manner.

First, a paint for the electrical conducting layer was prepared by the following procedure. 50 parts of electrically conductive titanium oxide particle covered with tin oxide containing antimonium oxide of 10%, 25 parts of phenol resin, 20 parts of methyl cellosolve, 5 parts of methanol, and 0.002 part of silicone oil (polydimethylsiloxane polyoxyalkylene copolymer, average molecular weight 3000) were dispersed for 2 hours by a sand mill apparatus using glass beads having a diameter of 1 mm and were prepared. This paint was applied onto an aluminum cylinder having a diameter of 84 mm and a length of 340 mm by an immersion applying method, and was dried at 140° C. for 30 minutes to thereby form an electrically conducting layer having a film thickness of 16 μm.

Next, 5 parts of N-methoxymethylated nylon was dissolved in 95 parts of methanol to thereby prepare coating liquid for the undercoat layer. This coating liquid was applied onto the above-described electrically conducting layer by the immersion applying method, and was dried at 100° C. for 20 minutes to thereby form an undercoat layer having a film thickness of 0.4 μm.

Next, 10 parts of crystal type hydroxygallium phthalocyanine (HoGaPc) having strong peaks at 7.4°, 9.9°, 16.3°, 18.6°, 25.1° and 28.2° of Bragg angle (2θ±0.2°) in characteristic X-ray diffraction, 5 parts of polyvinylbutyral (trade name: S-LEC BX-1, produced by Sekisui Chemical Industry Co., Ltd.) and 250 parts of cyclohexanone were dispersed for 3 hours by a sand mill apparatus using glass beads having a diameter of 1 mm, and thereafter 250 parts of ethyl acetate was added thereto to thereby prepare coating liquid for the charge generating layer. This coating liquid was applied onto the above-described undercoat layer by the immersion applying method, and was dried at 100° C. for 15 minutes so that the film thickness of the charge generating layer adhering onto the undercoat layer might be 0.2 μm. At this time, the amount of a charge generating substance contained in the charge generating layer was 130 $mg/m^2$.

Figure 9:
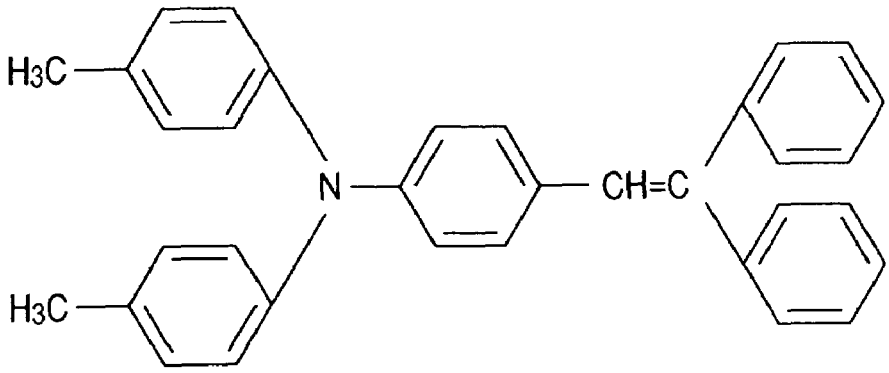
FIG. 9 shows the structural formula of a charge transport material.
Figure 10:
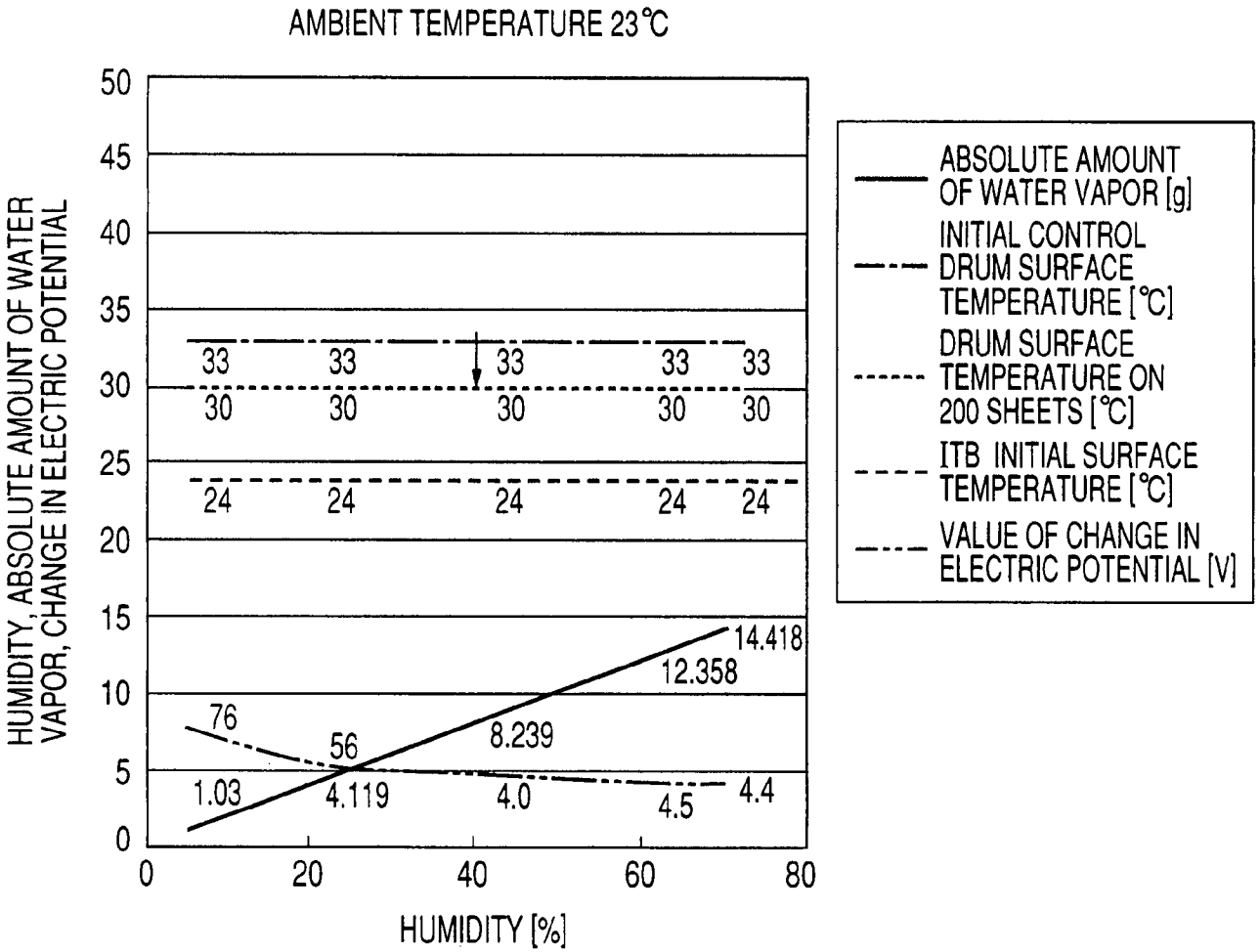
FIG. 10 is a graph illustrating the relations among the humidity, temperature, absolute amount of water vapor and change in electric potential of an embodiment when the ambient temperature is 23° C.

Next, 7 parts of charge transport material which is a styryl compound of a structural formula shown in FIG. 9 and 10 parts of polycarbonate (weight average molecular weight=46000) were dissolved in a mixed solvent of 28 parts of methylal/65 parts of monochlorobenzene to thereby prepare a solution, and this solution was immersion-applied to the surface of the charge generating layer, and was dried at 100° C. for 60 minutes to thereby form a charge transport layer having a film thickness of 16 μm.

Figure 16:
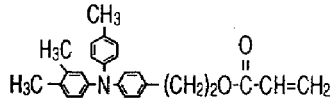
FIG. 16 shows the structure expressions of compounds used for the surface protective layer of a photosensitive member.
Figure 16:
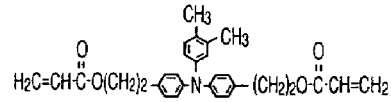
Figure 16:
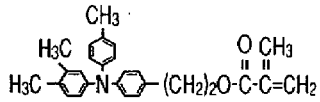
Figure 16:
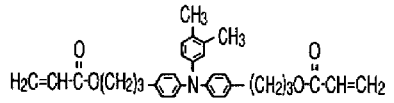
Figure 16:
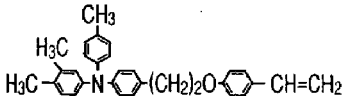
Figure 16:
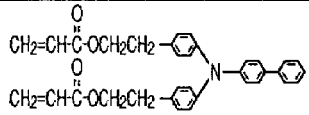
Figure 16:
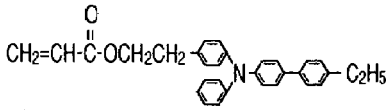
Figure 16:
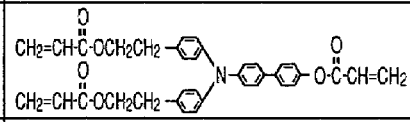
Figure 16:
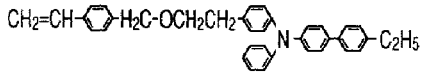
Figure 16:
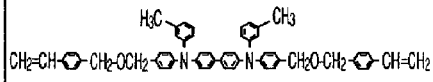
Figure 16:
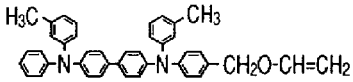
Figure 16:
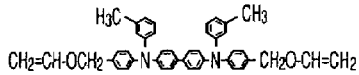
Figure 16:
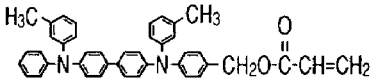
Figure 16:
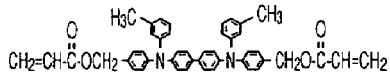
Figure 16:
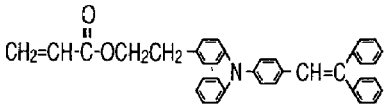
Figure 16:
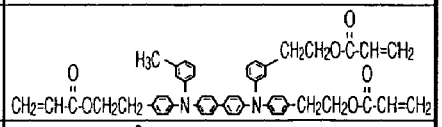
Figure 16:
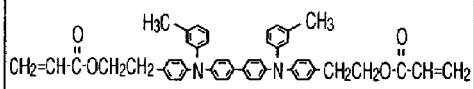
Figure 16:
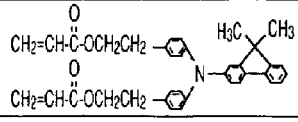
Figure 16:
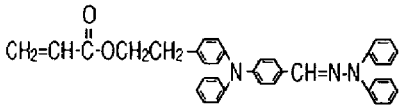
Figure 16:
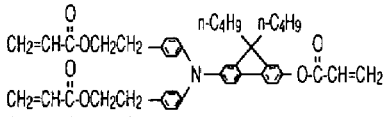

Next, 40 parts of compound shown in Compound Example No. 12 shown in FIG. 16 was dissolved in a mixed solvent 60 parts of n-propanol to thereby prepare a paint for the surface protecting layer. This paint was applied onto the aforementioned charge transport layer by the immersion applying method, and was dried at 50° C. for 15 minutes, whereafter an electron ray was applied under a nitrogen atmosphere of oxygen density of 10 ppm or less under the condition of an accelerating voltage 150 kV and an amount of absorbed electron ray $5\times10^4$ Gy, and the paint was heated and dried at 100° C. under the same atmosphere for 10 minutes to thereby harden the above-mentioned compound, thereby forming a surface protecting layer having a film thickness of 5 μm, and preparing a photosensitive member.

Discretely from the above-described photosensitive member, as the undercoat layer, a sample of a single-layer construction was made on PET film provided with a comb-shaped electrode by a wire bar so as to have a film thickness of 0.4 μm. As the result of the measurement of the resistivity thereof, the resistivity was $5\times10^8$ Ω·cm under an environment of temperature 25° C. and humidity 55%.

This photosensitive member was mounted on the image forming apparatus shown in FIG. 1, and a continuous 200 sheets supply endurance test was carried out. Also, by the use of this photosensitive member, an electric potential sensor instead of the developing device was set at the position of the developing device in the image forming apparatus main body to thereby confirm a change in electric potential corresponding to continuous 200 sheets. The initial electric potential setting of the surface potential is effected at dark portion potential Vd of 700 V and light portion potential V1 of 220 V, and the values of changes in electrical potential before and after the endurance are shown in FIG. 18. FIGS. 19A and 19B show portions of FIG. 18 on an enlarged scale. The value of V1 was measured by a surface potentiometer (Model 366 produced by Trek Co., Inc.), and in the image formation on a sheet of A4 size, the average electric potential of all points (sampling frequency 5 kHz) in the circumferential direction of the photosensitive member during the exposure time was adopted as the value of V1.

As can be seen from FIG. 18, when the initial surface temperature of the photosensitive member was adjusted to 33° C. under an environment of the absolute amount of water vapor of less than 15 $g/m^3$, the drum surface temperature at a time corresponding to 200 sheets was 30° C. and the value of change in electric potential V1 was a very small value. Also, any change in the apparent color of images outputted by continuous sheet supply was not visually perceived, and 200 sheets of images equal in apparent color could be obtained. Further, on this photosensitive member, endurance was effected up to 10,000 sheets, but injury and shaving were almost absent, and it could be confirmed that this photosensitive member is a photosensitive member of very high durability.

Also, under an environment of temperature 30° C. and humidity 80% in which the absolute amount of water vapor was as high as 15 g/m$^3$ or greater, the initial surface temperature of the photosensitive member could be controlled to 45° C. to thereby prevent the occurrence of an image deletion.

Conversely in Embodiment 1, Comparative Example A, even under a low-humidity environment, constant control to 45° C. was adopted, and in the low-humidity environment, the value of change in electric potential became a great value.

In Embodiment 1-2, however, by the heater provided in the intermediate transfer member, the surface temperature (ITB initial surface temperature) of the intermediate transfer member is maintained high when the image forming apparatus main body is left unused, thereby reducing the fluctuation of the electric potential under a low-humidity environment.

Also, in Embodiment 1, Comparative Example B, the initial surface temperature of the drum is set to 40° C., but in that case, under a low-humidity environment, the fluctuation of electric potential is great, and under a high-humidity environment, an image deletion occurs.

That is, under a low-humidity environment and a high-humidity environment, Embodiment 1 has two humidity settings, whereby it becomes possible to solve the respective problems.

FIGS. 10 to 15 are graphs for illustrating the result shown in FIG. 18 in greater detail.

These show the numerical values of Embodiment 1 and Embodiment 1, Comparative Example A made into graphs for each value of humidity. Embodiment 1 relates to a case where it has two humidity settings, and Embodiment 1, Comparative Example A relates to a case where 4.5° C. and a constant humidity setting are adopted.

Figure 11:
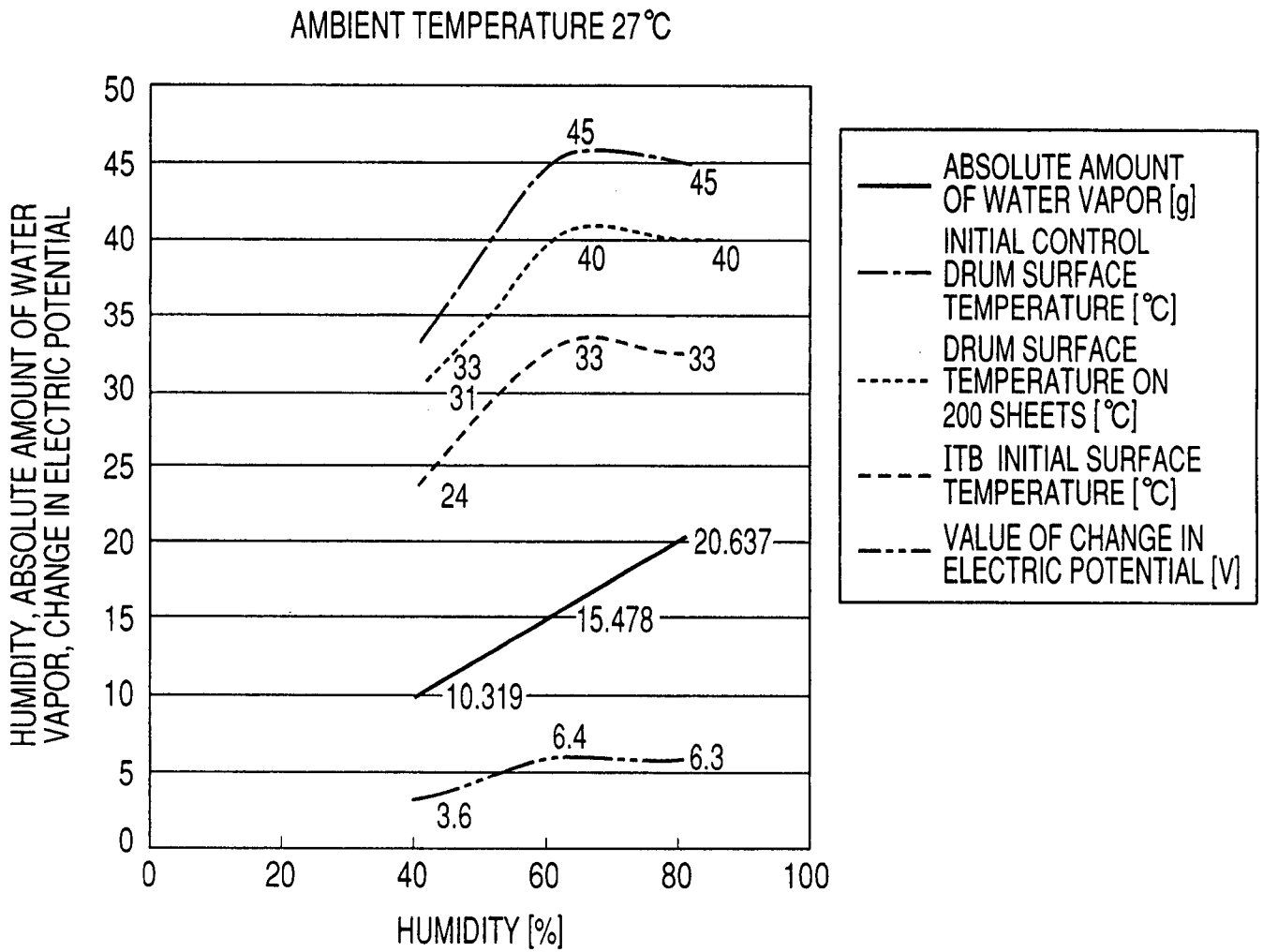
FIG. 11 is a graph illustrating the relations among the humidity, temperature, absolute amount of water vapor and change in electric potential of the present embodiment when the ambient temperature is 27° C.

FIG. 10 shows the case of Embodiment 1, and the environment shown therein is an environment in which the ambient temperature is 23° C. and therefore the absolute amount of water vapor is low in spite of high humidity. This graph shows that when the drum temperature is adjusted to 33° C., the temperature falls as indicated by a downward arrow (↓) after sheet supply, but the temperature fall level is small and therefore, a change in electric potential is small. In contrast, FIG. 13 relates to Embodiment 1, Comparative Example A, and shows that the drum temperature is set at 45° C. corresponding to a high temperature and high humidity and therefore, temperature fall is great and the change in electric potential is high. FIG. 11 shows a 27° C. environment which assumes an area of a medium amount of water vapor. This case is the area of a changeover point at which only when the humidity is 40%, the temperature is set at 33° C., and in the case of higher humidity, the temperature is set at 45° C. Also in Embodiment 1, Comparative Example A shown in FIG. 14, the temperature is high and therefore, the change in electric potential does not become so great.

Accordingly, the adjustment of the drum temperature to 33° C. or 45° C. would not pose so great a problem, but yet in the case of high humidity, image deletion will occur unless a high temperature is maintained.

Figure 12:
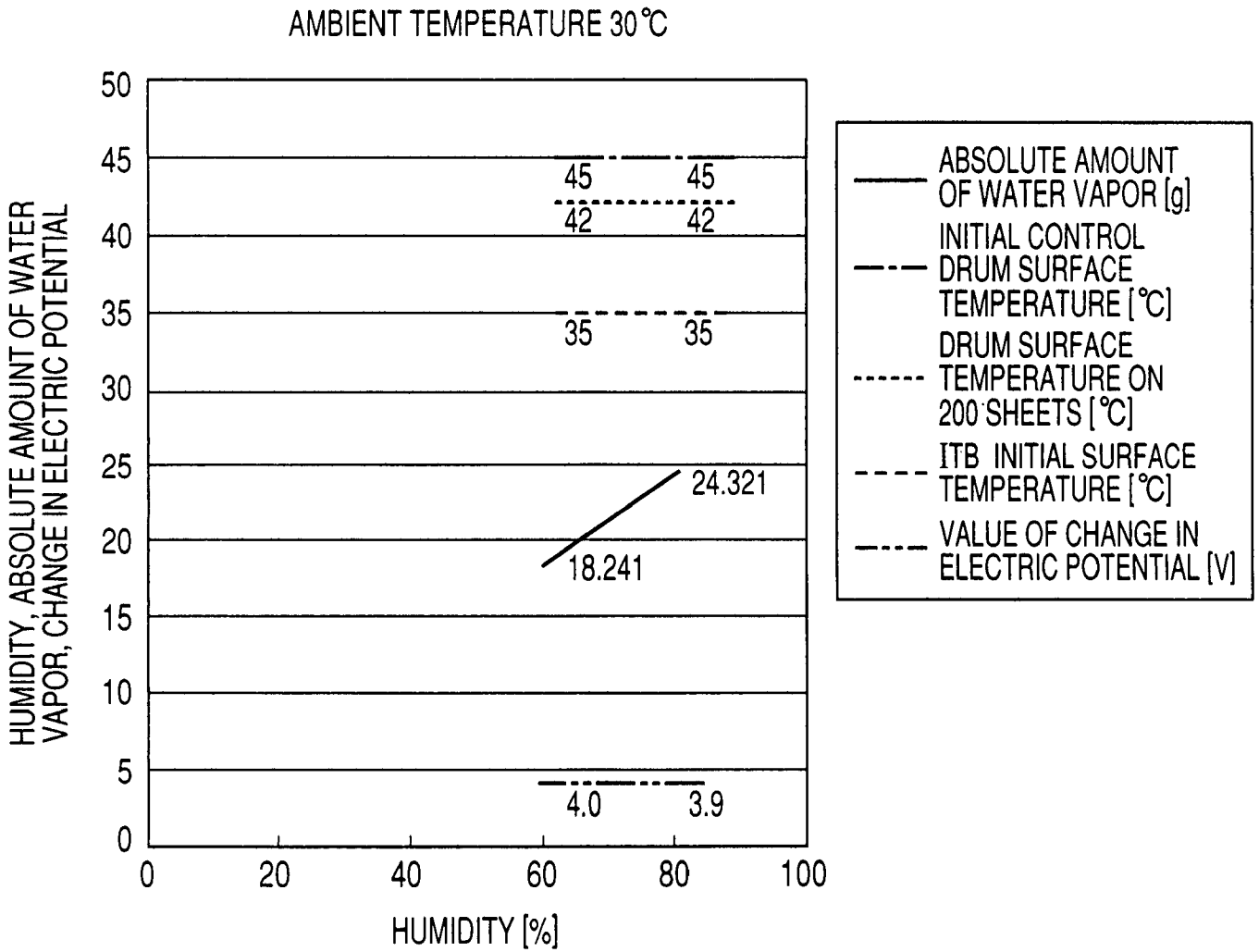
FIG. 12 is a graph illustrating the relations among the humidity, temperature, absolute amount of water vapor and change in electric potential of the present embodiment when the ambient temperature is 30° C.
Figure 13:
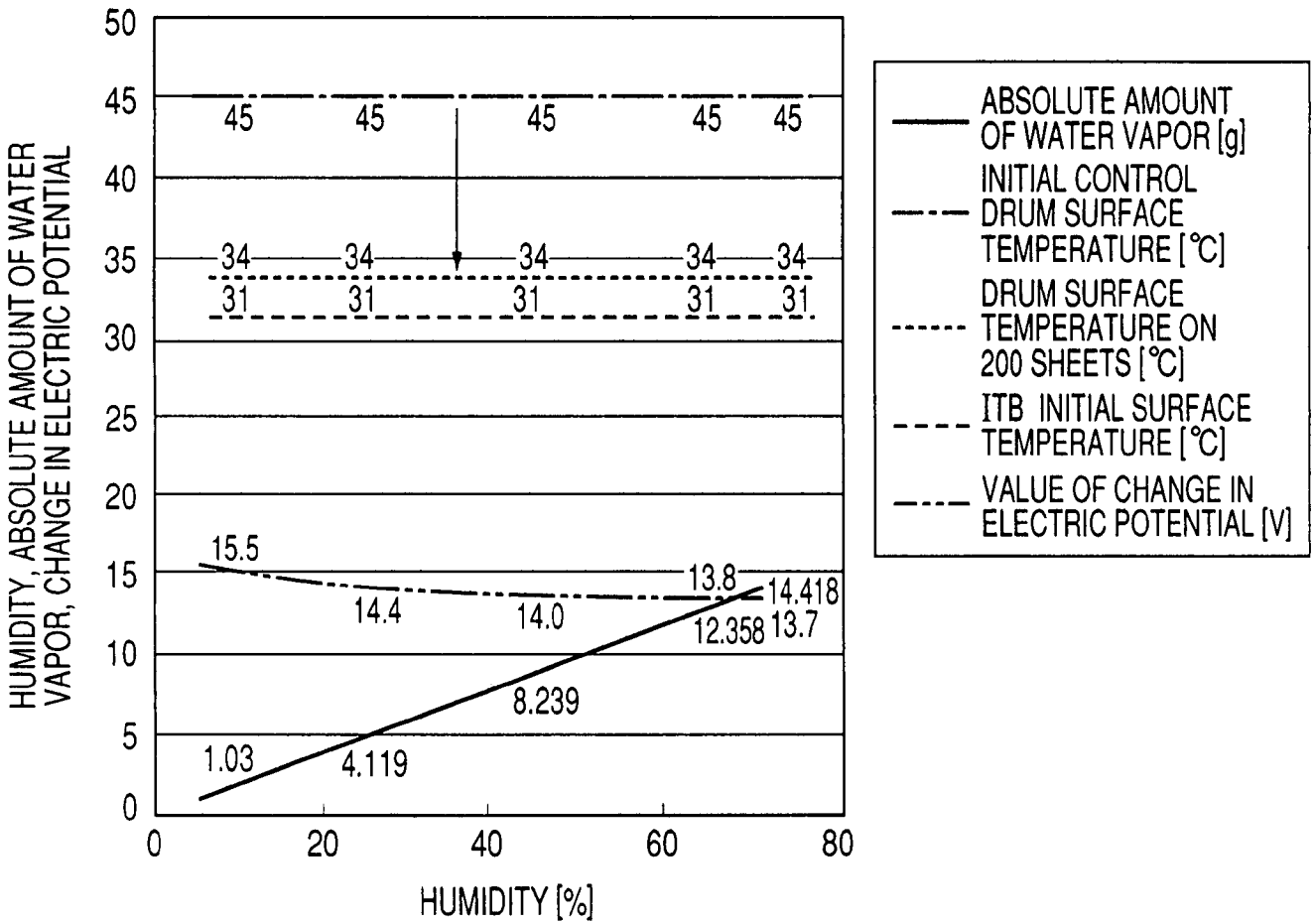
FIG. 13 is a graph illustrating the relations among the humidity, temperature, absolute amount of water vapor and change in electric potential of a comparative example when the ambient temperature is 23° C.
Figure 14:
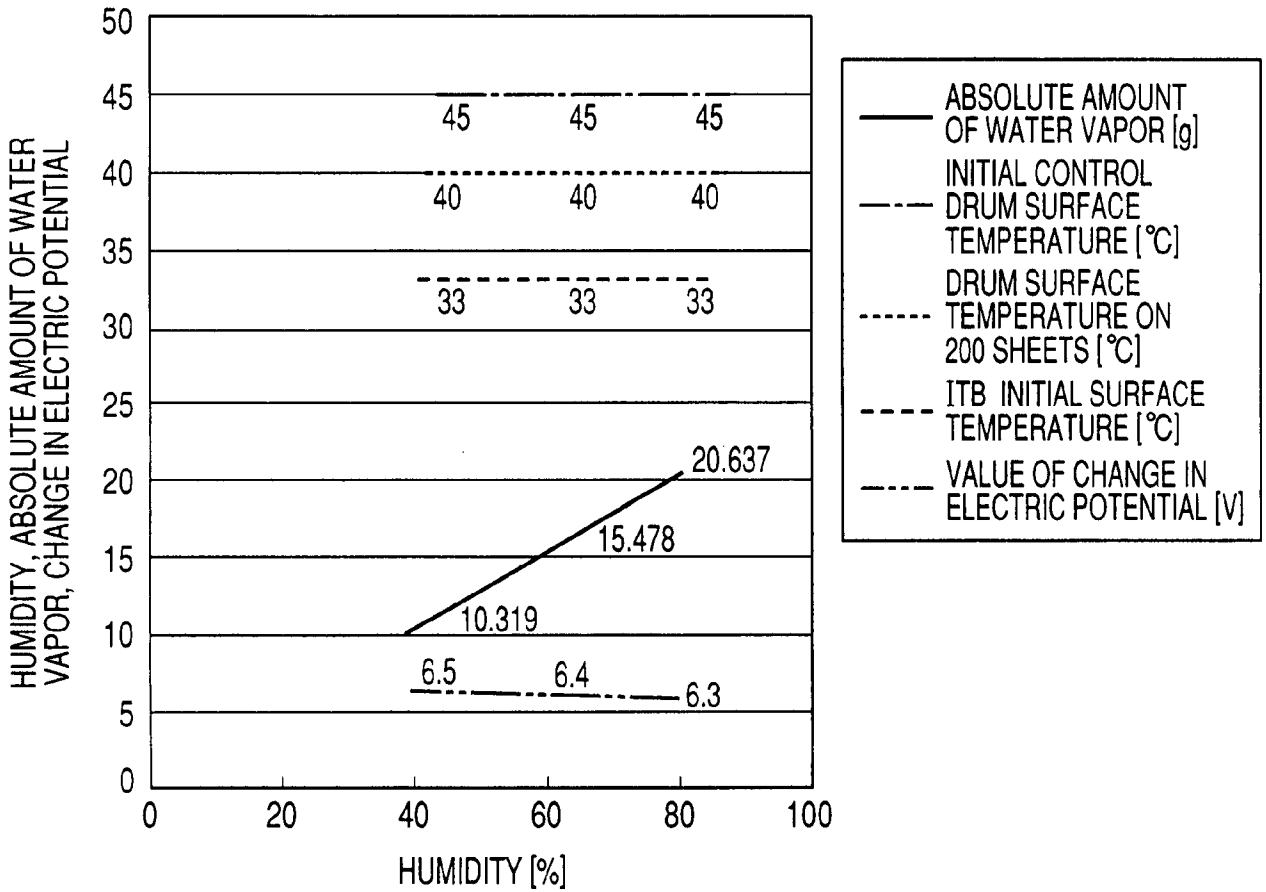
FIG. 14 is a graph illustrating the relations among the humidity, temperature, absolute amount of water vapor and change in electric potential of the comparative example when the ambient temperature is 27° C.
Figure 15:
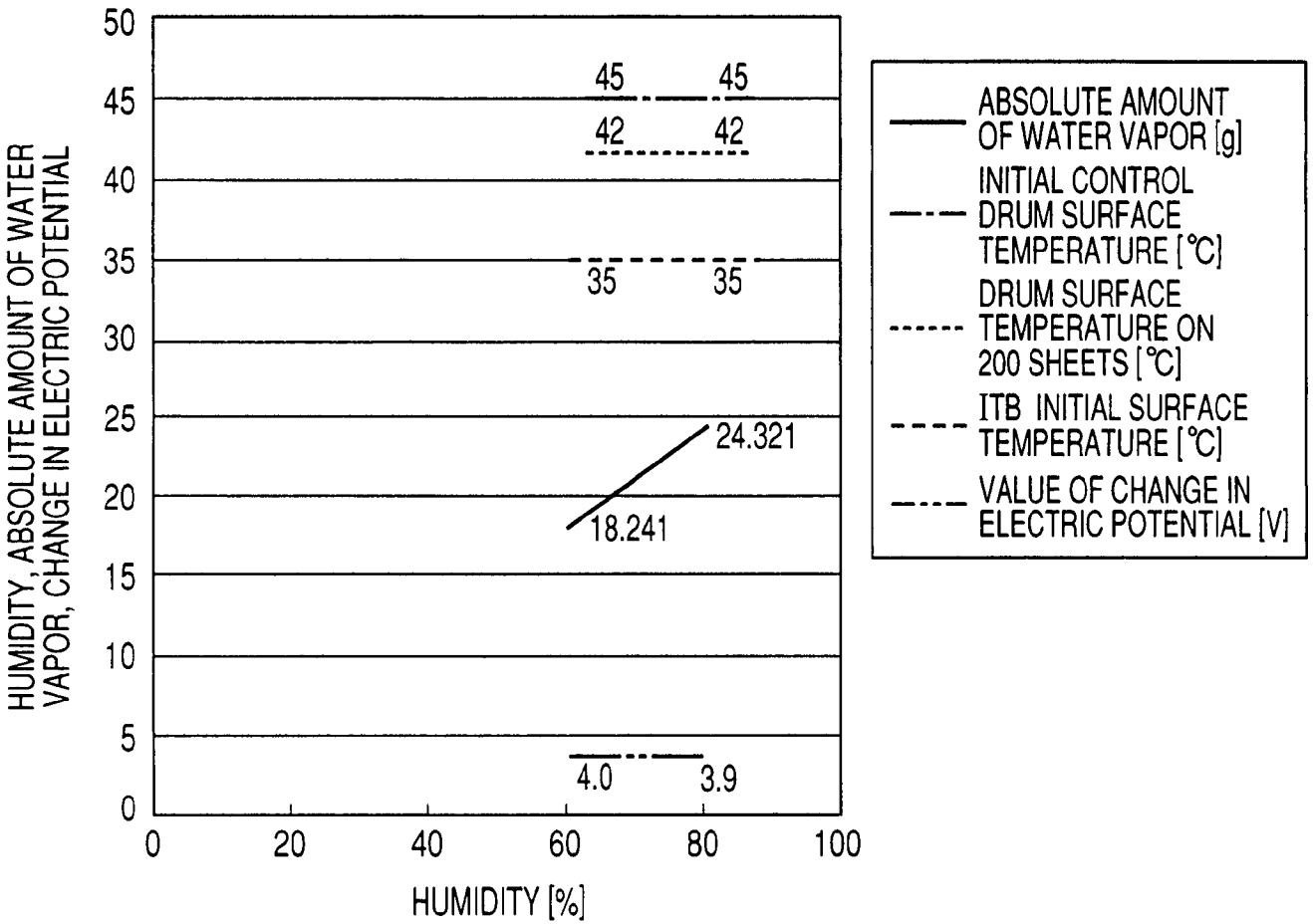
FIG. 15 is a graph illustrating the relations among the humidity, temperature, absolute amount of water vapor and change in electric potential of the comparative example when the ambient temperature is 30° C.

FIG. 12 relates to a high-temperature high-humidity environment. In the first place, an image deletion poses a problem and therefore, 45° C. setting must be adopted, but the fluctuation of electric potential poses no problem.

Also, as a comparative example, in the case of constant control to 33° C., the pattern becomes such that at a high temperature and high humidity, an image deletion is NG, and in the case of 45° C. setting only for a high temperature and high humidity, the pattern becomes such that in a low-humidity environment, the fluctuation of V1 is NG.

Also, Embodiment 1-2 in FIG. 18 shows that a further effect is obtained by the use of the control of maintaining the ITB (intermediate transfer belt as an intermediate transfer member) at a high temperature, and Embodiment 1, Comparative Example B shows how the matter would end in the case of constant control of medium 40° C.

It will be seen that an image deletion is NG both at a high humidity and low humidity.

Figure 17:
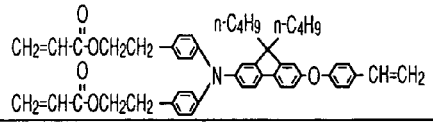
FIG. 17 shows the structure expressions of compounds used for the surface protective layer of the photosensitive member.
Figure 17:
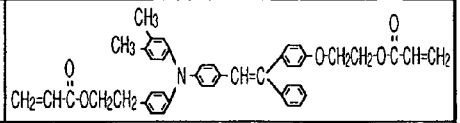
Figure 17:
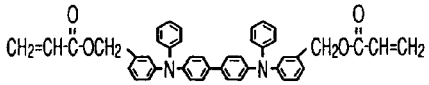
Figure 17:
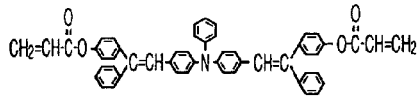
Figure 17:
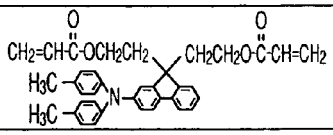
Figure 17:
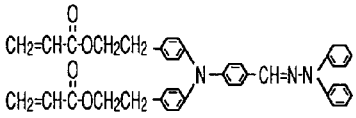
Figure 17:
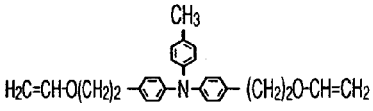
Figure 17:
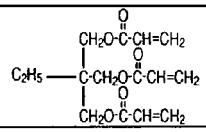
Figure 17:
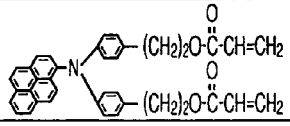
Figure 17:
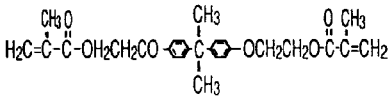
Figure 17:
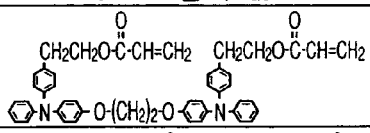
Figure 17:
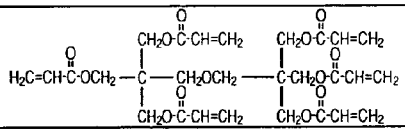
Figure 17:
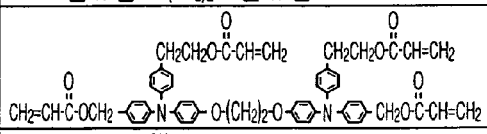
Figure 17:
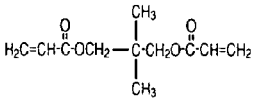
Figure 17:
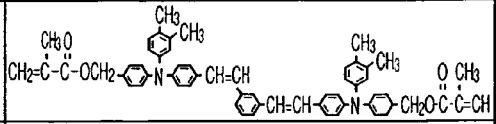
Figure 17:
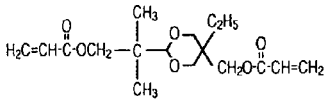
Figure 17:
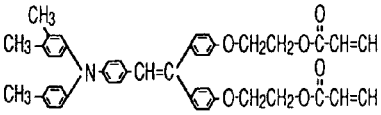
Figure 17:
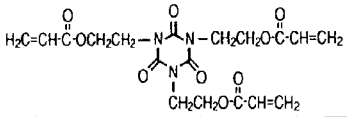
Figure 17:
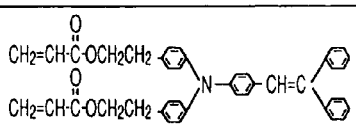
Figure 17:
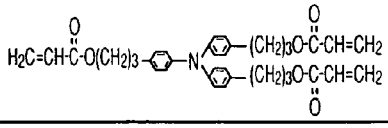

In Embodiments 2 to 8, a photosensitive member (photosensitive drum) of such a construction as shown in FIGS. 16 and 17 is prepared, and the measurement of the fluctuation of electric potential similar to that in FIG. 18 is effected.

Also, Comparative Examples 1 to 7 show the construction of a conventional drum to which an electron ray is not applied, and in these examples, similar measurement was effected. The result of the measurement is similar to that in the case of Embodiment 1, and it has been found that when use is made of the drum in the present invention, drum surface temperature setting conforming to the environment is important.

Embodiment 2

With the exception that the amount of adherence, after coating, of the charge generating substance of the photosensitive member onto the undercoat layer in Embodiment 1 was 90 mg/m$^2$, as in Embodiment 1, a continuous 200 sheets supply endurance test was carried out while the surface temperature was controlled by the temperature raising apparatus so as to become 35° C. Also, by the use of this photosensitive member, an electric potential sensor, instead of the developing device, was set at the position of the developing device in the main body, to thereby confirm a change in electric potential corresponding to continuous 200 sheets. The initial potential setting of the surface potential was effected at Vd 700 V and V1 220 V, and the values of changes in electric potential before and after the endurance are shown in FIG. 18. The value of V1 was measured by a surface potentiometer (Model 366 produced by Trek Co., Inc.), and in image formation on a sheet of A4 size, the average electric potential of all points (sampling frequency 5 kHz) in the circumferential direction of the photosensitive member during the exposure time was adopted as the value of V1.

As can be seen from FIG. 18, the value of the change in electric potential V1 at a time corresponding to 200 sheets was a very small value. Also, a change in the apparent color of images outputted in continuous sheet supply was not visually perceived, and 200 sheets of images having the same apparent color could be obtained. Further, on this photosensitive member, endurance was effected up to 10,000 sheets, but injuries and shaving were almost absent thereon, and it could be confirmed that this photosensitive member is a photosensitive member of very high durability.

Embodiment 3

By a construction and a method similar to those in Embodiment 1 with the exception that the compound of FIG. 16 used for the surface protecting layer in Embodiment 1 was replaced by a compound No. 14 in FIG. 16, a surface protecting layer and a photosensitive layer were manufactured to thereby manufacture a photosensitive member.

A photosensitive member manufactured under the same condition as this photosensitive member was left unused under an environment of temperature 25° C. and humidity 50% for 24 hours.

About this photosensitive member, evaluation similar to that in Embodiment 1 was effected by the use of the image forming apparatus shown in Embodiment 1. The result is shown in FIG. 18. As shown in FIG. 18, faulty images attributable to the injuries of that portion of the surface of the photosensitive member which is in contact with the charging roller did not occur even when the endurance of 300K sheets (300,000 sheets) was effected, and the higher durability of the photosensitive member could be achieved in the image forming apparatus by the aforedescribed AC current value.

Also, when the depth of the deepest injuries was measured on the surface of the photosensitive member at the point of time corresponding to the endurance of 250K sheets, the result was 1.9 μm on the average of 8-point measurement in the circumferential direction of the photosensitive member.

Embodiment 4

4 parts of polytetrafluoroethylene fine particles (particle diameter 0.18 μm) was added to the paint for the surface protecting layer in Embodiment 1, and was dissolved in a solvent of 60 parts of n-propanol together with 36 parts of compound shown at Compound Example No. 12 in FIG. 16 to thereby prepare a paint for the surface protecting layer. This paint was applied onto the charge transport layer by the immersion applying method and was dried at 50° C. for 15 minutes, whereafter an electron ray was applied thereto under a nitrogen atmosphere under the condition of an accelerating voltage 150 kV and an amount of absorbed electron ray $5\times10^4$ Gy, and the paint was dried at 100° C. for 60 minutes, and the compound was hardened to thereby form a surface protecting layer having a film thickness of 5 μm and manufacture an electrophotographic photosensitive member.

A photosensitive member manufactured under the same condition as this photosensitive member was left unused under an environment of temperature 25° C. and humidity 50% for 24 hours.

About this photosensitive member, evaluation similar to that in Embodiment 1 was effected by the use of the image forming apparatus shown in Embodiment 1. The result is shown in FIG. 18. As shown in FIG. 18, faulty images attributable to the injuries of that portion of the surface of the photosensitive member which is in contact with the charging roller did not occur even when the endurance of 300K sheets was effected, and the higher durability of the photosensitive member could be achieved in the image forming apparatus by the above-described AC current value.

Also, when the depth of the deepest injuries was measured on the surface of the photosensitive member at the point of time corresponding to the endurance of 250K sheets, the result was 1.2 μm on the average of 8-point measurement in the circumferential direction of the photosensitive member.

Embodiment 5

A surface protecting layer and a photosensitive layer were manufactured to thereby manufacture a photosensitive member, by a construction and a method similar to those in Embodiment 1 with the exception that the amount of absorbed electron ray in Embodiment 1 changed to $4\times10^5$ Gy, and after the application of the electron ray, the processing was changed to a post-heating process in the atmosphere.

A photosensitive member manufactured under the same condition as this photosensitive member was left unused under an environment of temperature 25° C. and humidity 50% for 24 hours.

About this photosensitive member, evaluation similar to that in Embodiment 1 was effected by the use of the image forming apparatus shown in Embodiment 1. The result is shown in FIG. 18. As shown in FIG. 18, faulty images attributable to the injuries of that portion of the surface of the photosensitive member which is in contact with the charging roller did not occur even when the endurance of 300K sheets was effected, and the higher durability of the photosensitive member could be achieved in an image forming apparatus by the above-described AC current value.

Also, when the depth of the deepest injuries was measured on the surface of the photosensitive member at the point of time corresponding to the endurance of 250K sheets, the result was 3.3 μm on the average of 8-point measurement in the circumferential direction of the photosensitive member.

Embodiment 6

A photosensitive member having a photosensitive layer and a surface protecting layer similar to those in Embodiment 1 was manufactured.

About this photosensitive member, evaluation similar to that in Embodiment 1 was effected with the AC current value of the charging roller of the image forming apparatus in Embodiment 1 being $2.3\times10^4$ c/m$^2$. As shown in FIG. 18, faulty images attributable to the injuries of that portion of the surface of the photosensitive member which is in contact with the charging roller did not occur even when the endurance of 300K sheets was effected, and the higher durability of the photosensitive member could be achieved in an image forming apparatus by the above-described AC current value.

Also, when the depth of the deepest injuries was measured on the surface of the photosensitive member at the point of time corresponding to 250K sheets, the result was 1.1 μm on the average of 8-point measurement in the circumferential direction of the photosensitive member.

Embodiment 7

A surface protecting layer and a photosensitive layer were manufactured to thereby manufacture a photosensitive member, by a construction and a method similar to those in Embodiment 1 with the exception that the pushing pressure of the charging roller of the image forming apparatus in Embodiment 1 was about 5 kg/m$^2$.

A photosensitive member manufactured under the same condition as this photosensitive member was left unused under an environment of temperature 25° C. and humidity 50% for 24 hours.

About this photosensitive member, evaluation similar to that in Embodiment 1 was effected by the use of the image forming apparatus shown in Embodiment 1. The result is shown in FIG. 18. As shown in FIG. 18, faulty images attributable to the injuries of that portion of the surface of the photosensitive member which is in contact with the charging roller did not occur even when the endurance of 300K sheets was effected, and the higher durability of the photosensitive member could be achieved in an image forming apparatus by the above-described AC current value.

Also, when the depth of the deepest injuries was measured on the surface of the photosensitive member at the point of time corresponding to the endurance of 250K sheets, the result was 1.9 μm on the average of 8-point measurement in the circumferential direction of the photosensitive member.

Embodiment 8

A surface protecting layer and a photosensitive layer were manufactured to thereby manufacture a photosensitive member, by a construction and a method similar to those in Embodiment 1 with the exception that the compound used for the surface protecting layer was replaced by a compound of No. 40 in FIG. 17, and the amount of absorbed electron ray was changed to $4\times10^5$ Gy.

A photosensitive member manufactured under the same condition as this photosensitive member was left unused under an environment of temperature 25° C. and humidity 50% for 24 hours.

About this photosensitive member, evaluation similar to that in Embodiment 1 was effected by the use of the image forming apparatus shown in Embodiment 1. The result is shown in FIG. 18. As shown in FIG. 18, faulty images attributable to the injuries of that portion of the surface of the photosensitive member which is in contact with the charging roller did not occur even when the endurance of 300K sheets was effected, and the higher durability of the photosensitive member could be achieved in an image forming apparatus by the above-described AC current value.

Also, when the depth of the deepest injuries was measured on the surface of the photosensitive member at the point of time corresponding to the endurance of 250K sheets, the result was 1.2 μm on the average of 8-point measurement in the circumferential direction of the photosensitive member.

Comparative Example 1

A surface protecting layer and a photosensitive layer were manufactured to thereby manufacture a photosensitive member, by a construction and a method similar to those in Embodiment 1 with the exception that the intersected axes angle between the charging roller and the photosensitive drum of the image forming apparatus in Embodiment 1 is absent.

The result of the evaluation of the above-described photosensitive member effected as in Embodiment is shown in FIG. 18. As shown in FIG. 18, faulty images attributable to the injuries of that portion of the surface of the photosensitive member which is in contact with the charging roller occurred for the endurance of 170K sheets.

When at this time, the depth of the deepest injuries was measured on the surface of the photosensitive member, the result was 5.8 μm on the average of 8-point measurement in the circumferential direction of the photosensitive member.

Comparative Example 2

A surface protecting layer and a photosensitive layer were manufactured to thereby manufacture a photosensitive member, by a construction and a method similar to those in Embodiment 1 with the exception that the intersected axes angle between the charging roller and the photosensitive member of the image forming apparatus in Embodiment 1 was changed to 0.3°.

The result of the evaluation of the above-described photosensitive member effected as in Embodiment 1 is shown in FIG. 18. As shown in FIG. 18, faulty images attributable to the injuries of that portion of the surface of the photosensitive member which is in contact with the charging roller occurred for the endurance of 220K sheets.

When at this time, the depth of the deepest injuries was measured on the surface of the photosensitive member, the result was 4.2 μm on the average of 8-point measurement in the circumferential direction of the photosensitive member.

Comparative Example 3

Evaluation similar to that in Embodiment 1 was effected by the use of a photosensitive member lacking the surface protecting layer of Embodiment 1 and having its charge transport layer manufactured with a thickness of 28 μm, and the image forming apparatus shown in Embodiment 1. The result is shown in FIG. 18. As shown in FIG. 18, faulty images attributable to the injuries of that portion of the surface of the photosensitive member which is in contact with the charging roller occurred for the endurance of 70K sheets.

When at this time, the depth of the deepest injuries was measured on the surface of the photosensitive member, the result was 8.6 μm on the average of 8-point measurement in the circumferential direction of the photosensitive member.

Comparative Example 4

A surface protecting layer and a photosensitive layer were manufactured to thereby manufacture a photosensitive member, by a construction and a method similar to those in Embodiment 1 with the exception that the amount of absorbed electron ray in Embodiment 5 was changed to $1\times10^5$ Gy.

This photosensitive member was left unused under an environment of temperature 25° C. and humidity 50% for 24 hours.

The result of the evaluation of the above-described photosensitive member effected as in Embodiment 1 is shown in FIG. 18. As shown in FIG. 18, faulty images attributable to the injuries of that portion of the surface of the photosensitive member which is in contact with the charging roller occurred for the endurance of 100K sheets.

When at this time, the depth of the deepest injuries was measured on the surface of the photosensitive member, the result was 9.2 μm on the average of 8-point measurement in the circumferential direction of the photosensitive member.

Comparative Example 5

A surface protecting layer and a photosensitive layer were manufactured to thereby manufacture a photosensitive member, by a construction and a method similar to those in Embodiment 1 with the exception that the compound used for the surface protecting layer in Embodiment 1 was replaced by the compound of No. 36 in FIG. 17, and film having a film thickness of 1 μm was formed.

A photosensitive member manufactured under the same condition as this photosensitive member was left unused under an environment of temperature 25° C. and humidity 50% for 24 hours, whereafter the modulus of elastic deformation and HU were found by the use of the aforedescribed hardness measuring apparatus, Fischer Scope H100V (produced by Fischer Co., Inc.). The values thereof are shown in FIG. 20.

The result of the evaluation of the above-described photosensitive member effected as in Embodiment 1 is shown in FIG. 18. As shown in FIG. 18, faulty images attributable to the injuries of that portion of the surface of the photosensitive member which is in contact with the charging roller occurred for the endurance of 80K sheets.

When at this time, the depth of the deepest injuries was measured on the surface of the photosensitive member, the result was 11 μm on the average of 8-point measurement in the circumferential direction of the photosensitive member.

Comparative Example 6

After the charge transport layer in Comparative Example 3 was formed, coating liquid provided by mixing and dispersing 1 part by weight of hydrophobic silica particles with and in a solution comprising 10 parts of polycarbonate resin used for the charge transport layer and dissolved in a mixed solvent of 100 parts of monochlorobenzene and 60 parts of dichloromethane was applied onto the aforedescribed CTL by a spray applying machine to thereby form a protective layer having a film thickness of 1.0 μm, thereby manufacturing a photosensitive member. This photosensitive member was left unused under an environment of temperature 25° C. and humidity 50% for 24 hours.

The result of the evaluation of the above-described photosensitive member effected as in Embodiment 1 is shown in FIG. 18. As shown in FIG. 18, faulty images attributable to the injuries of that portion of the surface of the photosensitive member which is in contact with the charging roller occurred for the endurance of 40K sheets.

When at this time, the depth of the deepest injuries was measured on the surface of the photosensitive member, the result was 9 μm on the average of 8-point measurement in the circumferential direction of the photosensitive member.

Comparative Example 7

A surface protecting layer and a photosensitive layer similar to those in Comparative Example 1 were manufactured to thereby manufacture a photosensitive member, and the evaluation of this photosensitive member was effected by a construction and a method similar to those in Embodiment 1 with the exception that the AC current value of the charging roller of the image forming apparatus in Comparative Example 1 was changed to $2.3\times10^4$ c/m$^2$. The result is shown in FIG. 18. As shown in FIG. 18, faulty images attributable to the injuries of that portion of the surface of the photosensitive member which is in contact with the charging roller occurred for the endurance of 230K sheets.

When at this time, the depth of the deepest injuries was measured on the surface of the photosensitive member, the result was 3.3 μm on the average of 8-point measurement in the circumferential direction of the photosensitive member.

According to the above-described embodiments, by controlling the surface temperature of the photosensitive member to at least two stages of set temperatures in accordance with the use environment, and setting the aforementioned surface temperature at a high temperature particularly when the photosensitive member is used under an environment in which the absolute amount of water vapor is great, it is possible to suppress the fluctuation of density due to the fluctuation of the electric potential of the exposed portion, and output images free of the occurrence of image deletion for a long period of time.

This application claims priority from Japanese Patent Application No. 2004-306256 filed Oct. 20, 2004, which is hereby incorporated by reference herein.

What is claimed is:

1. An electrophotographic image forming apparatus comprising:

a photosensitive member of which a surface layer contains a compound of which at least one polymerization functional group has been hardened by electron irradiation;

image forming means for forming a toner image on said photosensitive member;

heating means for heating said photosensitive member;

temperature detecting means for detecting a temperature of said photosensitive member;

controlling means for controlling an operation of said heating means in accordance with an output of said temperature detecting means so that the temperature of said photosensitive member maintains a target temperature;

temperature/humidity detecting means for detecting an ambient temperature and humidity; and setting means for setting the target temperature in accordance with an output of said temperature/humidity detecting means;

an intermediate transfer member for transferring the toner image transferred from said photosensitive member to a recording material;

auxiliary heating means for heating said intermediate transfer member;

temperature detecting means for detecting a temperature of said intermediate transfer member;

controlling means for controlling an operation of said auxiliary heating means in accordance with a detected temperature of said intermediate transfer member so that the temperature of said intermediate transfer member maintains a target temperature; and setting means for setting the target temperature of said intermediate transfer member at a temperature equal to or higher than the ambient temperature and equal to or lower than the target temperature of said photosensitive member.

2. An electrophotographic image forming apparatus comprising:

a photosensitive member of which a surface layer contains a compound of which at least one polymerization functional group has been hardened by electron irradiation;

image forming means for forming a toner image on said photosensitive member;

heating means for heating said photosensitive member;

controlling means for controlling a temperature of said photosensitive member, wherein when a boundary value of an absolute amount of water vapor is defined as 12-16 g/m$^3$, the temperature of said photosensitive member is maintained at 28-35° C. when the absolute amount of water vapor is less than the boundary value, and the temperature of said photosensitive member is maintained at 37-55° C. when the absolute amount of water vapor is equal to or greater than the boundary value;

an intermediate transfer member for transferring the toner image transferred from said photosensitive member to a recording material;

heating means for heating said intermediate transfer member; and controlling means for controlling a temperature of said intermediate transfer member, wherein the temperature of said intermediate transfer member is maintained at a temperature equal to or higher than an ambient temperature and equal to or lower than the temperature of said photosensitive member.

* * * * *

UNITED STATES PATENT AND TRADEMARK OFFICE

CERTIFICATE OF CORRECTION

PATENT NO. : 7,395,001 B2
APPLICATION NO. : 11/251925
DATED : July 1, 2008
INVENTOR(S) : Fumiteru Gomi It is certified that error appears in the above-identified patent and that said Letters Patent is hereby corrected as shown below:

TITLE PAGE [75] Inventor

"Fumiteru Gomi, Chiba-ken (JP)" should read --Fumiteru Gomi, Abiko (JP)--.

COLUMN 4

Line 46, "enlarge" should read --enlarged--.

COLUMN 9

Line 32, "the," should read --the--.
Line 46, "per once." should read --per one degree.--.

COLUMN 11

Line 57, "material 4" should read --material 4,--; and "image" should read --image,--.

COLUMN 13

Line 58, "crystal type" should read --crystal-type--.

COLUMN 22

Line 9, "and" (second occurrence) should be deleted.
Line 37, "member;" should read --member; and--.

Signed and Sealed this

Twenty-seventh Day of January, 2009

JOHN DOLL
*Acting Director of the United States Patent and Trademark Office*